US006386682B1

(12) United States Patent
Kimura

(10) Patent No.: US 6,386,682 B1
(45) Date of Patent: May 14, 2002

(54) INK-JET HEAD AND DRIVING METHOD OF THE SAME

(75) Inventor: Koichi Kimura, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/234,491

(22) Filed: Jan. 21, 1999

(30) Foreign Application Priority Data

Jan. 23, 1998 (JP) ..... 10-011697

(51) Int. Cl.[7] ..... B41J 2/04
(52) U.S. Cl. ..... 347/54
(58) Field of Search ..... 347/68, 69, 70, 347/71, 72, 50, 40, 6, 54, 20, 44, 47, 27, 63; 399/261; 361/700; 310/328–330; 29/890.01

(56) References Cited

U.S. PATENT DOCUMENTS 6,130,689 A * 10/2000 Choi ..... 347/54

* cited by examiner

*Primary Examiner*—Raquel Yvette Gordon
(74) *Attorney, Agent, or Firm*—Sughrue Mion, PLLC

(57) ABSTRACT

An ink-jet head comprises at least one ink chamber having an ink supply port and an ink ejection port, a flexible member constituting a part of one inner wall of the ink chamber, a signal electrode provided on the flexible member, a common electrode provided where is opposed to the signal electrode with void therebetween, a power supply section for applying driving voltage between the signal electrode and the common electrode in accordance with print information to elastically deform the flexible member toward the common electrode by electrostatic force acting therebetween.

30 Claims, 27 Drawing Sheets

INK-JET HEAD AND DRIVING METHOD OF THE SAME

BACKGROUND OF THE INVENTION

The present invention relates to an ink-jet head using electrostatic force for a driving source for ejecting ink.

An ink-jet head for ejecting ink by pressurization and printing the ejected ink on recording paper has a bubble type which generates a bubble with a heating element to jet ink. In the bubble-type ink-jet head 1, a heating element 5 is provided in a nozzle 3 as shown in FIG. 51 and ink 7 is supplied to the rear part of the nozzle 3 (an upper part in FIG. 51) from an ink cartridge not shown. When the heating element 5 is heated, a bubble 9 is generated in the nozzle 3 and ink pushed out by the bubble 9 is ejected toward recording paper not shown as an ink droplet 7*a*. When driving voltage is turned off, the bubble 9 disappears, ink 7 flows into the nozzle 3 by capillarity. Repeating it, printing on the recording paper is performed.

An ink-jet head also has a piezoelectric element type using a piezoelectric element and others for a driving source for ejecting ink. In the piezoelectric element-type ink-jet head 11, as shown in FIG. 52, a pin 15 is fixed to the end of a piezoelectric element 13 the base end of which is fixed and the end of the pin 15 is inserted in a nozzle 17. An ink passage 19 is connected to the nozzle 17 and ink 7 is supplied to the ink passage 19 from an ink cartridge not shown. When a driving pulse is applied to the piezoelectric element 13, the piezoelectric element 13 is displaced and the pin 15 is moved in the nozzle 17 so that the ink passage 19 is opened or closed. The ink 7 is sucked by reduced pressure in the nozzle 17 and is ejected as an ink droplet 7*a* because the pin 15 enters the nozzle 17 again.

However, as the above bubble-type ink-jet head is required to heat ink instantaneously and generate a bubble, there is disadvantage that driving power is large. There is a problem that as time required since a driving pulse is applied to a heating element until a bubble is generated is delayed due to various factors such as the exoergic efficiency of a heating element, thermal conductivity between the heating element (a solid) and ink (fluid) and the temperature dependency characteristics of ink itself, it is difficult to improve the responsibility.

In the meantime, there is disadvantage that in the piezoelectric element-type ink-jet head, high driving voltage is required to acquire physical quantity such as pressure and oscillation. There is also a problem that the sensitivity of conversion is relatively low and it is thus Difficult to improve the responsibility. Further, there is a problem that as the ink-jet head is required to have resonant structure with deforming material if the ink-jet head is integrated with the deforming material, the design is difficult. It is also expected that the ink-jet head is connected to an electronic circuit to be an integrated circuit by forming a piezoelectric element on the same substrate, however, in this case, there is a problem that micronization and integration is difficult by a method of forming a thick film and the formation of a piezoelectric film itself is difficult by a method of forming a thin film.

To solve such problems, there is proposed an ink-jet head wherein ink is ejected by deforming a diaphragm wall, which constitutes a part of an ink chamber, by electrostatic force (Maxwell stress).

For example, U.S. Pat. No. 4,520,375 discloses an ink-jet head wherein ink is ejected by providing a parallel flat diaphragm made of a semiconductor on one side of an ink chamber and pressurizing after reducing pressure by electrostatic force.

Unexamined Japanese Patent Publication No. Hei 5-50601 discloses an ink-jet head provided with plural nozzle apertures, plural ejecting chamber communicating with each nozzle aperture and a diaphragm for deforming a part of the ejecting chamber wherein ink is ejected by deforming the diaphragm with electrostatic force so that the ejecting chamber is under reduced pressure and pressurizing the ejecting chamber when the diaphragm is restored afterward.

Unexamined Japanese Patent Publication No. Hei 6-106725 discloses an ink-jet head wherein ink is ejected from the end of a nozzle by forming a nozzle with a rigid electrode and an elastic electrode opposite, making ink with a high dielectric constant flow into the nozzle and applying voltage between both electrodes to deform the elastic electrode in the direction of the rigid electrode with electrostatic attraction.

The ink-jet heads according to these methods have advantages that driving voltage can be reduced, compared with the above bubble-type and the above piezoelectric element type, high speed driving is enabled, large scale integration is enabled, the degree of freedom in selecting the material of the element is high, the design is easy and in addition, a driving circuit can be integrated by forming the ink-jet head with a semiconductor such as silicon.

However, for these ink-jet heads, means for achieving high speed ejecting and efficient ejecting is not referred. The control of gradation and the correction of the quantity of ink when multiple nozzles are provided are also not referred.

There are the following problems to realize the above high speed ejecting and the above efficient ejecting:

That is, in an ink chamber, an ink ejection port and an ink supply port exist. There occurs a problem that as simultaneously, ink reversely flows toward a reservoir from the ink supply port if the ink chamber is pressurized and ink is ejected from the ink ejection port, energy efficiency for ejecting ink is bad (efficient ejecting cannot be executed) and ink cannot be ejected at high speed. To solve the problem, the passage resistance of the ink supply port is required to be set to a higher value, compared with that of the ink ejection port.

In the meantime, there occurs a problem that when the passage resistance of an ink supply port is high if an ink chamber is decompressed and ink is supplied from the ink supply port, ink supply speed is reduced and ink cannot be supplied at high speed. In this case, bubbles may invade from an ink ejection port. To solve the problem, the passage resistance of the ink supply port is required to be reduced, compared with that of the ink ejection port.

Since these conditions conflict with each other, in the related arts, a neutral value is acquired based upon both compromised values and the passage resistance of an ink supply port and an ink ejection port is determined.

To solve such a problem, Unexamined Japanese Patent Publication No. Hei 9-141855 discloses an ink-jet head wherein an ink supply port is tapered, however, there is a limit in effect because passage resistance is controlled every direction in which ink flows, depending upon only the shape of a passage.

There are the following problem in relation to the control of gradation:

That is, heretofore, there has been known a method of controlling the gradation by varying directly the concentration or the area of an ink droplet to vary the quantity of ejected ink by means of controlling the degree of pressurization (value, applied time, or the number of pulses of voltage). However, in the case of an ink-jet head, as the volume of an ink chamber is very large, compared with the volume of a ejected ink droplet, it is difficult to control the quantity of an ink droplet precisely.

To solve these problems, Unexamined Japanese Patent Publication No. Hei 9-193385 discloses an ink-jet head wherein the control of gradation and correction in ejecting from plural nozzles are enabled by means of pressurizing by a single piezoelectric element and plural buckled valve means based upon generated heat. However, pressurizing by a piezoelectric element has a problem that a response is slow as described above and driving voltage is high. A built-in assembly of a piezoelectric element costs high and is not suitable for large scale integrated multi-nozzle. The buckled valve depends upon thermal expansion, is slow in a response, and the reliability and the life are also questionable. Further, as one pressurizing member makes ink ejected from plural nozzles, correction is required. For the correction of the quantity of ink in the case of multi-nozzle, there are the following problem:

That is, a multi-nozzle-type head provided with plural ink chambers communicating with a reservoir has a problem that the high quality of ink ejecting cannot be obtained because of interference between adjacent nozzles.

To solve such a problem, Unexamined Japanese Patent Publication No. Hei 5-193149 discloses an ink-jet head wherein a valve is provided to the end of a nozzle (an ink supply port) to prevent interference between adjacent nozzles. However, pressurizing member depends upon a bubble (thermal bubble) method, and speedup and the reliability are questionable. The structure of the valve and the assembly are complicated. Further, the object of the structure is to prevent interference between adjacent nozzles and is not high speed ejecting and the control of gradation.

SUMMARY OF THE INVENTION

The present invention is made in view of the above situation and a first object is to obtain an ink-jet head wherein high speed responsibility can be obtained with low voltage.

Further, a second object is to obtain an ink-jet head wherein high speed ejecting and efficient ejecting are enabled.

Furthermore, a third object is to obtain an ink-jet head wherein the high quality of the control of gradation by varying the quantity of ink is enabled.

Furthermore, a fourth object is to obtain an ink-jet head wherein integration is enabled by a photolithographic process, the degree of the freedom of design can be enhanced, in addition, an integrated circuit is realized, and micronization and multiplicity are easy.

In order to achieve the above object, there is provided an ink-jet head comprising: at least one ink chamber having an ink supply port and an ink ejection port; a flexible member constituting a part of one inner wall of the ink chamber; a signal electrode provided on the flexible member; a common electrode provided where is opposed to the signal electrode with void defined therebetween; a power supply section for applying driving voltage between the signal electrode and the common electrode in accordance with print information to elastically deform the flexible member toward the common electrode by electrostatic force acting therebetween.

In the ink-jet head, as a flexible member is operated utilizing the electrostatic force, the high speed operation is enabled, compared with a case that a heating element or a piezoelectric element is used.

The elastic deformation of the flexible member pressurizes the ink chamber.

In the ink-et head, when voltage is applied between the common electrode and the signal electrode, the flexible member is attracted by Coulomb's force and bent, and ink in the ink chamber is ejected from the ink ejection port as an ink droplet. When voltage is turned off, the flexible plate is elastically restored, the ink chamber is decompressed and ink flows from the ink supply port to get ready for ejecting the next ink droplet.

The elastic deformation of the flexible member may decompress the ink chamber.

In the ink-jet head, when voltage is applied between the common electrode and the signal electrode, the flexible member is attracted by Coulomb's force and bent, and ink is supplied into the ink chamber from the ink supply port. When voltage is turned off, the flexible plate is elastically restored, the ink chamber is pressurized and ink in the ink chamber is ejected from the ink ejection port as an ink droplet.

A plurality of the ink chamber may be arranged on one band-like common electrode in the longitudinal direction thereof, and the power supply section selectively applies the drive voltage to the respective signal electrode provided on each of the flexible member in accordance with the print information.

In the ink-jet head, multiplicity in which an ink droplet is ejected from a desired ink chamber by selectively applying the driving voltage to each signal electrode based upon the printing information is enabled.

The ink-jet head may further comprise: a flexible valve member provided inside the ink chamber, the flexible valve member placed in the vicinity of at least one of the ink supply port and the ink ejection port; a valve electrode provided on the flexible valve member; a valve drive power supply section for applying valve driving voltage between the valve electrode and the common electrode in accordance with the print information to elastically deform the flexible valve member toward the common electrode by electrostatic force acting therebetween.

In the ink-jet head, the flexible member deformed by the electrostatic force serves as a pressure generating member the pressure generating member and the flexible valve member deformed by the same serves as a valve for the ink supply port and the ink ejection port. Thus, both of the pressure generating member and the valve can be produced with simple structure.

The flexible valve member may be deformed in a direction which is substantially perpendicular to an ink flowing direction.

In the ink-jet head, the flow of ink is not perpendicular to the surface of the valve and the valve can be opened or closed with small force without being influenced by the flow of ink.

The flexible valve member may be deformed in a direction which is substantially parallel to an ink flowing direction.

In the ink-jet head, as the ink ejection port or the ink supply port is opened or closed by the surface of the valve, the relatively large area of the opening can be securely opened or closed.

In case the flexible valve member is provided in the vicinity of the ink ejection port, and the ink chamber is pressurized when the driving voltage is applied, a numerical aperture of the ink ejection port is reduced by the valve member after the ink is ejected therefrom and then the application of the drive voltage by the power supply section is terminated.

In the method of driving the ink-jet head, as the numerical aperture of the ejection port is reduced when ink is supplied, reduced pressure operating upon the ink chamber is focused upon the ink supply port and efficient ink supply with few pressure loss is enabled.

In case the flexible valve member is provided in the vicinity of the ink supply port, and the ink chamber is pressurized when the driving voltage is applied, a numerical aperture of the ink supply port is reduced by the valve member after the ink is supplied therefrom and then the application of the drive voltage by the power supply section is started.

In the method of driving the ink-jet head, pressure upon the ink chamber is focused upon the ink ejection port by reducing the numerical aperture of the ink supply port when ink is ejected and efficient ink ejecting with few pressure loss is enabled.

In case the flexible valve members are provided both of in the vicinity of the ink supply port and in the vicinity of the ink ejection port, and the ink chamber is pressurized when the driving voltage is applied, a numerical aperture of the ink supply port is closed by the valve member after the ink is supplied therefrom and then the application of the drive voltage by the power supply section is started, and a numerical aperture of the ink ejection port is closed by the valve member after the ink is ejected therefrom and then the application of the drive voltage by the power supply section is terminated.

In the method of driving the ink-jet head, efficient ink ejecting with few pressure loss is enabled by reducing the numerical aperture of the ink supply port when ink is ejected and efficient ink supply with few pressure loss is enabled by reducing the numerical aperture of the ink ejection port when ink is supplied.

In case the flexible valve member is provided in the vicinity of the ink ejection port, and the ink chamber is decompressed when the driving voltage is applied, a numerical period of the ink ejection port is reduced by the valve member after the ink is ejected therefrom and then the application of the drive voltage by the power supply section is started.

In the method of driving the ink-jet head, as the numerical aperture of the ejection port is reduced when ink is supplied, reduced pressure operating upon the ink chamber is focused upon the ink supply port and efficient ink supply with few pressure loss is enabled.

In case the flexible valve member is provided in the vicinity of the ink supply port, and the ink chamber is decompressed when the driving voltage is applied, a numerical aperture of the ink supply port is reduced by the valve member after the ink is supplied therefrom and then the application of the drive voltage by the power supply section is terminated.

In the method of driving the ink-jet head, pressure upon the ink chamber is focused upon the ink ejection port by reducing the numerical aperture of the ink supply port when ink is ejected and efficient ink ejecting with few pressure loss is enabled.

In case the flexible valve members are provided both of in the vicinity of the ink supply port and in the vicinity of the ink ejection port, and the ink chamber is decompressed when the driving voltage is applied, a numerical aperture of the ink ejection port is reduced by the valve member after the ink is ejected therefrom and then the application of the drive voltage by the power supply section is started, and a numerical aperture of the ink supply port is reduced by the valve member after the ink is supplied therefrom and then the application of the drive voltage by the power supply section is terminated.

In the method of driving the ink-jet head, efficient ink ejecting with few pressure loss is enabled by reducing the numerical aperture of the ink supply port when ink is ejected and efficient ink supply with few pressure loss is enabled by reducing the numerical aperture of the ink ejection port when ink is supplied.

The valve drive power supply section may apply the valve drive voltage so the flexible valve member as to deform to vary a numerical aperture of the associated port.

In the method of driving the ink-jet head, the quantity of ejected ink can be arbitrarily controlled by changing the numerical aperture of at least one of the ink ejection port and the ink supply port, and the representation of gradation is enabled.

The valve drive power supply section may apply the valve drive voltage so the flexible valve member as to deform to vary a reduction period of a numerical aperture of the associated port.

In the method of driving the ink-jet head, the quantity of ejected ink can be arbitrarily controlled by varying the reduction period for at least one of the ink ejection port and the ink supply port, and the representation of gradation is enabled.

The common electrode may be divided into a first common electrode portion opposing to the signal electrode and a second common electrode portion opposing to the valve electrode.

In the ink-jet head, electric field crosstalk between electrodes can be reduced and the ink-jet head can be more precisely operated.

The ink-jet head may further comprise: a common reservoir communicated with a plurality of the ink chambers arranged on one band-like common electrode in the longitudinal direction thereof, wherein the power supply section selectively applies the drive voltage to the respective signal electrode provided on each of the flexible member in accordance with the print information, and the valve drive power supply section selectively applies the valve drive voltage to the respective valve electrode provided on each of the flexible valve member in accordance with the print information.

In the method of driving the ink-jet head, even if the plural ink chambers communicate with the reservoir, each pressure of adjacent ink chambers never interferes by controlling opening or closing a valve provided to the ink ejection port or the ink supply port every ink chamber, and efficient ink ejecting and efficient ink supply are enabled even in the multi-nozzle head.

Furthermore, the plural ink chambers can be integrated by photolithography, etching and others. As the valve is provided to at least one of the ink ejection port and the ink supply port, each pressure of adjacent ink chambers never interferes even if the adjacent ink chambers respectively communicate with the reservoir.

At least the common electrode, the ink chamber, the flexible member and the signal electrode are formed so as to be subsequently laminated by a photolithographic process.

In the ink-jet head, the main part such as the ink chamber can be formed in the photolithographic process, and the integration of the main part, micronization, the realization of an integrated circuit and multiplicity are easy.

The flexible member and the flexible valve member are one of a conductor and a conductor at least a part of over which is covered with insulator.

In the ink-jet head, large electrostatic force can be obtained by composing the flexible member and the flexible valve member of an electric conductor, and a short circuit and field emission can be prevented by covering an electric conductor with an insulator.

An ink-jet head disclosed in claim 4 is based upon an ink-jet head provided with an ink chamber having an ejection port and an ink supply port and pressure generating member provided to the ink chamber and characterized in that the ink chamber is pressurized or decompressed by deforming the pressure generating member with electrostatic force and ink in the ink chamber is ejected from the ejection port as an ink droplet, and is characterized in that a valve for arbitrarily changing the numerical aperture of the ejection port with electrostatic force is provided to the ink chamber.

In the ink-jet head, ink can be efficiently supplied from the ink supply port by closing the ejection port in supplying ink. An ejecting cycle can be reduced and high speed ejecting is enabled.

An ink-jet head disclosed in claim 5 is based upon an ink-jet head provided with an ink chamber having an ejection port and an ink supply port and pressure generating member provided to the ink chamber and characterized in that the ink chamber is pressurized or decompressed by deforming the pressure generating member with electrostatic force and ink in the ink chamber is ejected from the ejection port as an ink droplet, and is characterized in that a valve for arbitrarily changing the numerical aperture of the ink supply port with electrostatic force is provided to the ink chamber.

In the ink-jet head, pressurized ink can be efficiently ejected by closing the ink supply port in ejecting ink, an ejecting cycle can be reduced and high speed ejecting is enabled.

An ink-jet head disclosed in claim 6 is based upon an ink-jet head provided with an ink chamber having an ejection port and an ink supply port and pressure generating member provided to the ink chamber and characterized in that the ink chamber is pressurized or decompressed by deforming the pressure generating member with electrostatic force and ink in the ink chamber is ejected from the ejection port as an ink droplet, and is characterized in that a valve for arbitrarily and independently changing the numerical aperture of the ejection port and the ink supply port with electrostatic force is provided to the ink chamber.

In the ink-jet head, ink can be efficiently supplied from the ink supply port by closing the ejection port in supplying ink, pressurized ink can be efficiently ejected by closing the ink supply port when ink is ejected, an ejecting cycle is remarkably reduced and high speed ejecting is enabled.

An ink-jet head disclosed in claim 8 is characterized in that a valve is moved or turned with electrostatic force.

DETAILED DESCRIPTION OF THE PREFERRED EMBODIMENTS

Referring to the accompanying drawings, preferred embodiments of an ink-jet head according to the present invention will be described below.

Figure 1:
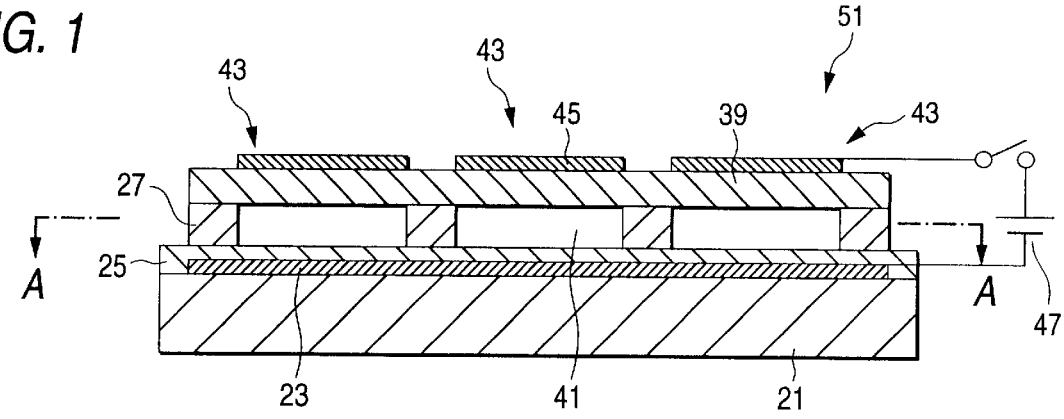
FIG. 1 is a sectional view showing an ink-jet head according to a first embodiment of the present invention.
Figure 2:
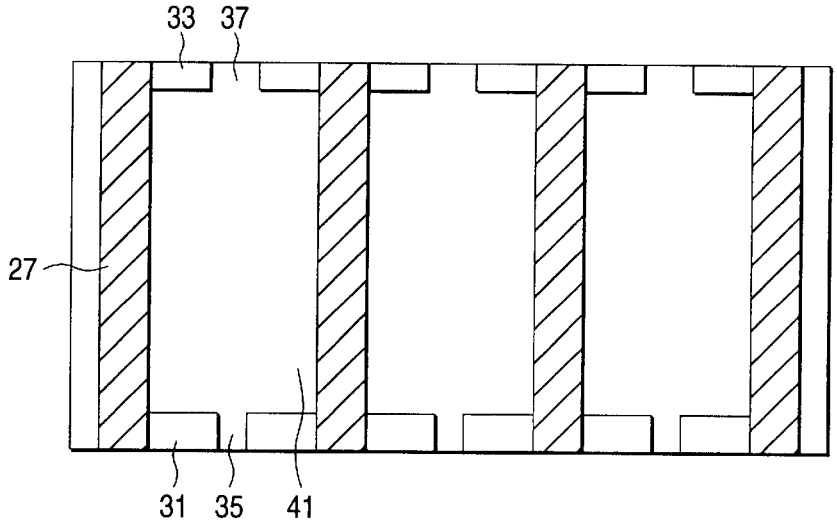
FIG. 2 is a drawing viewed along a line A—A in FIG. 1.

FIG. 1 is a sectional view showing an ink-jet head according to a first embodiment of the present invention and FIG. 2 is a drawing viewed along a line A—A in FIG. 1.

A band-like common electrode 23 is formed on a substrate 21 and the common electrode 23 is covered with an insulating electrode protecting film 25 formed over the substrate 21. Plural parallel partition walls 27 are formed on the electrode protecting film 25 at an equal interval in the longitudinal direction of the common electrode 23. The partition wall 27 can be formed by etching material having the same property as the electrode protecting film 25 for example.

Front walls 31 and rear walls 33 put between adjacent partition walls 27 are respectively formed at the front and rear ends on the substrate 21, and an ejection port 35 and an ink supply port 37 are respectively formed between the front walls 31 and between the rear walls 33. An insulating flexible plate 39 is adheredly provided on the upper surface of the partition walls 27, the front walls 31 and the rear walls 33. Hereby, plural ink chambers 43 respectively provided with a void 41 partitioned by the partition walls 27 and located between the electrode protecting film 25 and the flexible plate 39 are formed in the longitudinal direction of the common electrode 23.

The ink chamber 43 is provided with fluid-tight structure in which only the ejection port 35 and the ink supply port 37 are open. An ink cartridge is connected to the ink supply port 37 via an ink passage not shown. The ink supply port 37 is formed with the area of the opening considerably larger than the ejection port 35 so that ink flows into the ink chamber 43 only from the ink supply port 37 when the ink chamber 43 is decompressed.

Plural signal electrodes 45 are provided on the flexible plate 39 so as to be disposed above the associated ink chamber 43, respectively. Voltage based upon printing information is selectively applied between the signal electrode 45 and the common electrode 23 from a power source 47.

In an ink-jet head 51 constituted as described above, the substrate 21 can be formed by a resin film such as polyethylene terephthalate and polycarbonate, metallic oxide, an inorganic insulator such as a ceramic or a semiconductor in addition to a transparent glass plate.

The common electrode 23 can be formed by metal or a metallic compound having conductivity. In this case, for metal, gold, silver, palladium, zinc, aluminum and others may be used. For a metallic compound, iridium oxide, zinc oxide, aluminum oxide and others may be used.

The common electrode 23 can be formed by laminating a thin film made of the above conductive material on the surface of the substrate 21 by sputtering or vapor deposition, applying resist on the surface of the thin film, exposing and developing it. The above exposure can be executed by arranging a photomask on the photoresist, radiating ultraviolet rays on the photomask and the above development can be executed by processing using developer which can remove a fusible part of the photoresist.

The common electrode 23 is covered with the electrode protecting film 25 laminated over the substrate 21. A pressure chamber forming layer not shown is laminated on the electrode protecting film 25, and the partition wall 27, the front wall 31, the rear wall 33, the ejection port 35 and the ink supply port 37 are formed by etching the pressure chamber forming layer. The ink chamber 43 is formed by bonding the flexible plate 39 on the respective upper end faces of the partition wall 27, the front wall 31 and the rear wall 33. A thin film made of conductive material is laminated on the upper surface of the flexible plate 39 and the signal electrode 45 is formed by exposing and developing the thin film as in the case of the above common electrode 23. A power supply circuit connected to the common electrode 23 and the signal electrode 45 can be also patterned simultaneously when the common electrode 23 and the signal electrode 45 are formed.

Figure 3:
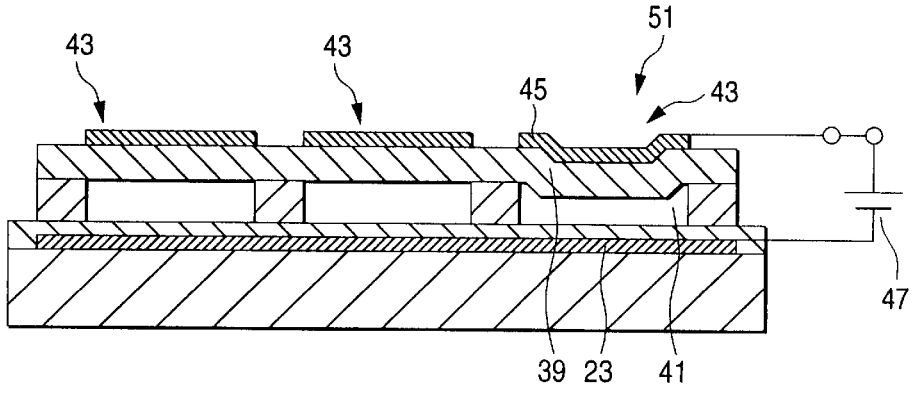
FIG. 3 is a sectional view for explaining the operation of the ink-jet head according to the first embodiment of the present invention.

FIG. 3 is a sectional view for explaining the operation of the ink-jet head according to the first embodiment of the present invention.

In the ink-jet head 51, when voltage is applied between the common electrode 23 and the signal electrode 45 by the power source 47, the flexible plate 39 is attracted by Coulomb's force and bent on the side of the void 41. Hereby, the ink chamber 43 is compressed and ink not shown in the ink chamber 43 is ejected from the ejection port 35 as an ink droplet.

When voltage is turned off, the flexible plate 39 is elastically restored, the ink chamber 43 is decompressed and ink flows into the void 41 from the ink supply port 37 to get ready for ejecting the next ink droplet. Therefore, a desired image can be formed by selectively applying voltage from the power source 47 to the respective signal electrodes 45 based upon printing information.

As according to the ink-jet head 51, the flexible plate 39 can be directly operated by Coulomb's force and can be driven with few physical loss and small power consumption comparing with the bubble-type ink-jet head in which a heating element is heated or the piezoelectric element-type ink-jet head in which a piezoelectric element.

In the bubble-type ink-jet head having many delay factors until bubbles are generated and the piezoelectric element-type ink-jet head the sensitivity of conversion of which is relatively low, the speedup of a response is also enabled.

As they are provided with structure in which the common electrode 23, the electrode protecting film 25, the ink chamber 43, the flexible plate 39 and the signal electrode 45 are sequentially laminated, the above can be integrated in a photolithographic process. Hereby, the above can be also integrated with a driving circuit over the silicon substrate.

Further, as one inner wall of the ink chamber 43 can be directly formed as the flexible plate 39, resonant structure with deforming material is not required differently from a case that it is required to be integrated with deforming material and the degree of the freedom of design can be enhanced.

As integration in a photolithographic process is enabled differently from the ink-jet head using the piezoelectric element requiring precise machining, micronization and multiplicity can be facilitated.

Next, an ink-jet head according to a second embodiment of the present invention will be described.

Figure 4:
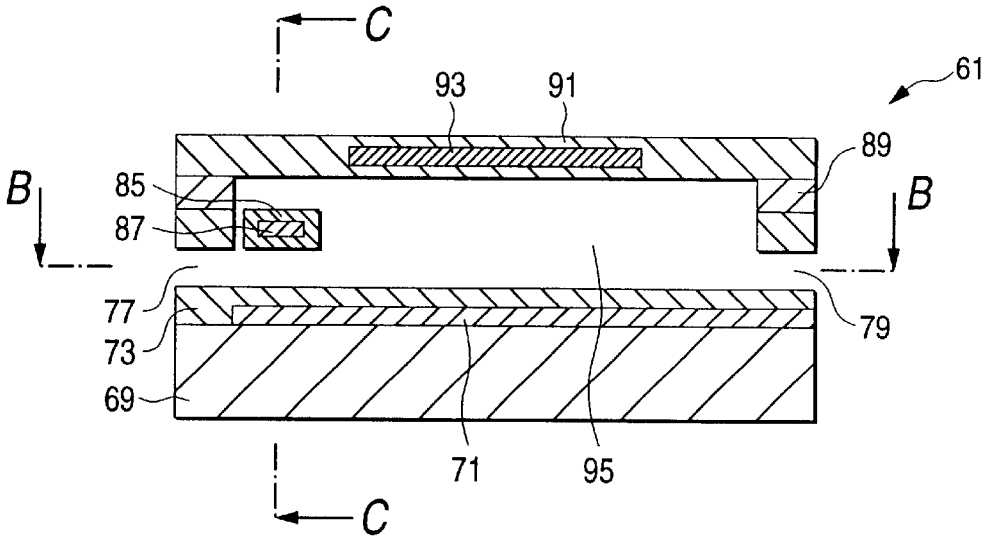
FIG. 4 is a sectional view showing an ink-jet head according to a second embodiment of the present invention.
Figure 5:
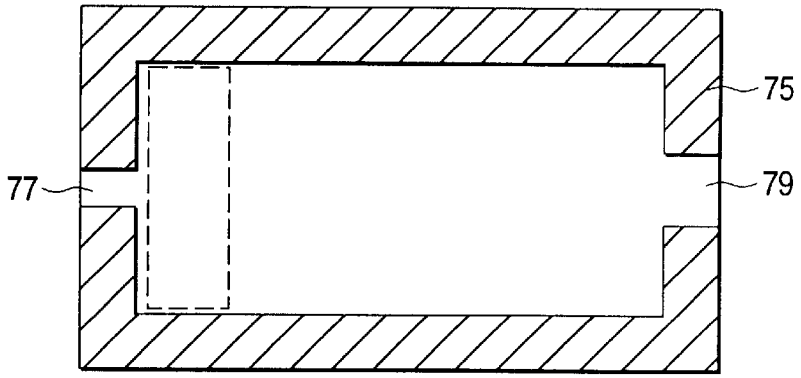
FIG. 5 is a drawing viewed along a line B—B in FIG. 4.
Figure 6:
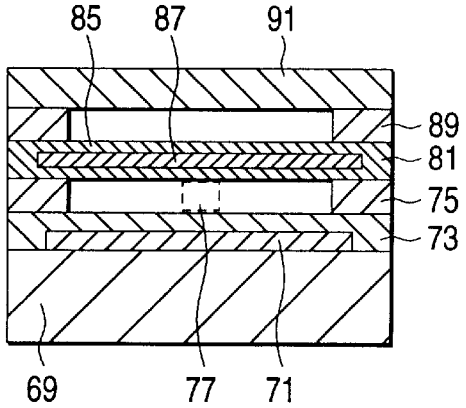
FIG. 6 is a drawing viewed along a line C—C in FIG. 4.
Figure 7:
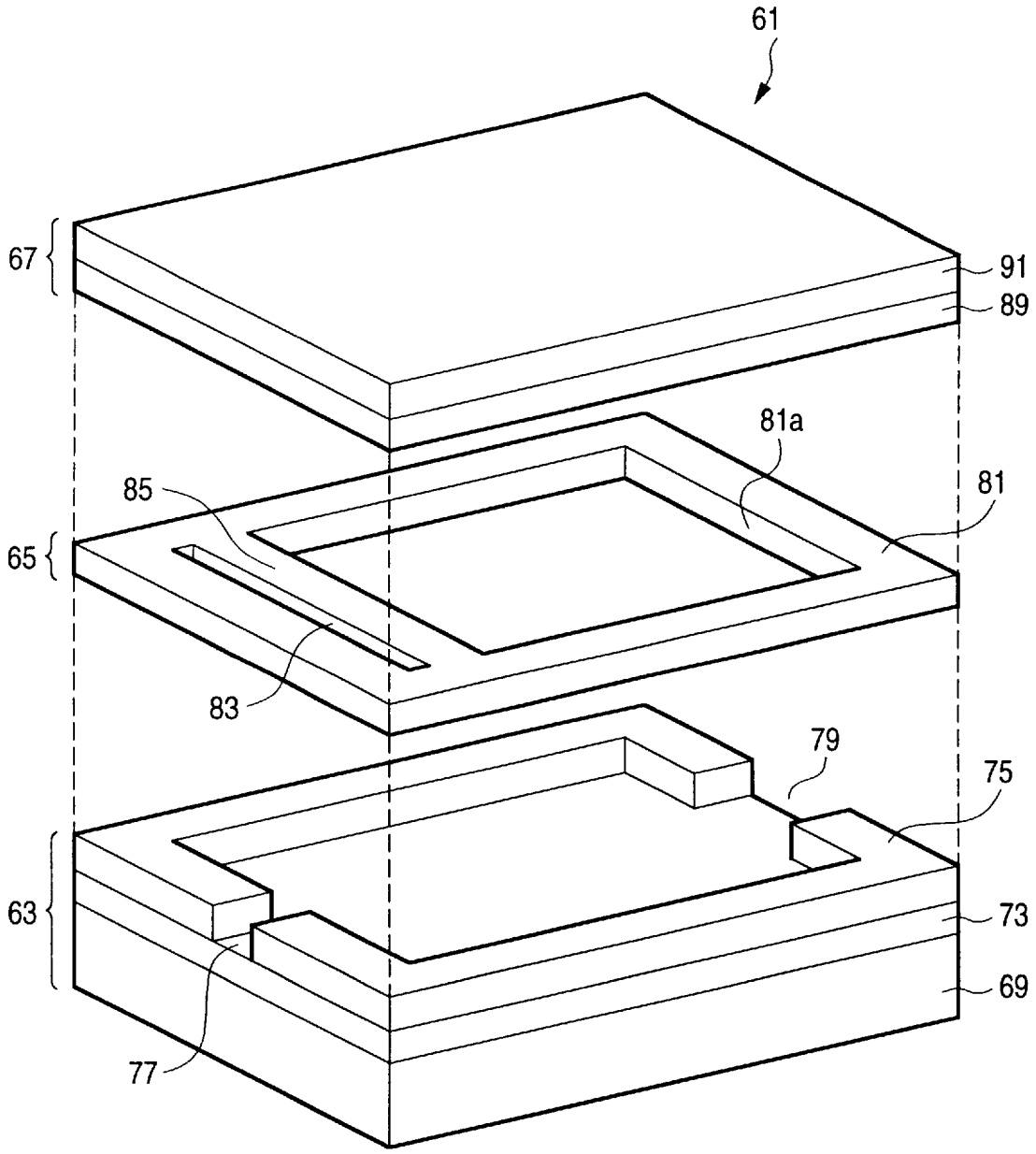
FIG. 7 is an exploded perspective drawing showing the ink-jet head in FIG. 4.

FIG. 4 is a sectional view showing the ink-jet head according to the second embodiment of the present invention, FIG. 5 is a drawing viewed along a line B—B in FIG. 4, FIG. 6 is a drawing viewed along a line C—C in FIG. 4 and FIG. 7 is an exploded perspective drawing showing the ink-jet head in FIG. 4.

The main part of the ink-jet head 61 according to the second embodiment is composed of a substrate part 63, a valve part 65 and a cover part 67. The substrate part 63 is further composed of a substrate 69, a common electrode 71, an electrode protecting layer 73 and a first peripheral wall 75. The common electrode 71 is formed on the substrate 69 and is covered with the insulating electrode protecting layer 73 formed over the substrate 69.

The first peripheral wall 75 in the shape of a rectangular frame is formed on the upper surface of the electrode protecting layer 73. A ejection port 77 is formed in one of the parallel opposite walls of the first peripheral wall 75 and an ink supply port 79 is formed in the other.

The valve part 65 is composed of a frame 81 in the approximately same shape as the first peripheral wall 75. The frame 81 is bonded to the upper end face of the first peripheral wall 75. A slit 83 is formed in the vicinity of one end of the frame 81 associated with the ejection port 77. A flexible member (an ejection port valve plate) 85 both ends of which are supported is formed between the slit 83 and an inner hole 81*a* by forming the slit 83 in the frame 81. The ejection port valve plate 85 is located over the inner opening of the ejection port 77 by laminating the frame 81 on the first peripheral wall 75. A conductive ejection port valve electrode 87 is formed inside the ejection port valve plate 85.

The cover part 67 is laminated on the upper surface of the frame 81. The cover part 67 is composed of a second peripheral wall 89 and an elastic pressurizing plate 91 serving as a pressure generating member. The second peripheral wall 89 is a rectangular frame in the approximately same shape of the first peripheral wall 75. The pressurizing plate 91 is laminated on the upper surface of the second peripheral wall 89. A pressurizing electrode 93 is formed is inside the pressurizing plate 91,.

Therefore, an ink chamber 95 the periphery of which is surrounded by the first peripheral wall 75, the frame 81 and the second peripheral wall 89 is formed between the electrode protecting layer 73 and the pressurizing plate 91. The ink chamber 95 is provided with fluid-tight structure with only the ejection port 77 and the ink supply port 79 respectively formed in the first peripheral wall 75 open. The ink chamber 95 is connected to a reservoir not shown via the ink supply port 79.

In the ink-jet head 61 constituted as described above, as in the above first embodiment, the substrate 69 may be formed by a resin film such as polyethylene terephthalate and polycarbonate, metallic oxide, an inorganic insulator such as a ceramic or a semiconductor in addition to a transparent glass plate. The common electrode 71, the ejection port valve electrode 87 and the pressurizing electrode 93 may be formed by metal or a metallic compound having conductivity. In this case, for metal, gold, silver, palladium, zinc, aluminum and others may be used and for a metallic compound, iridium oxide, zinc oxide, aluminum oxide and others may be used.

Next, the operation of the ink-jet head 61 constituted as described above will be described.

Figure 8:
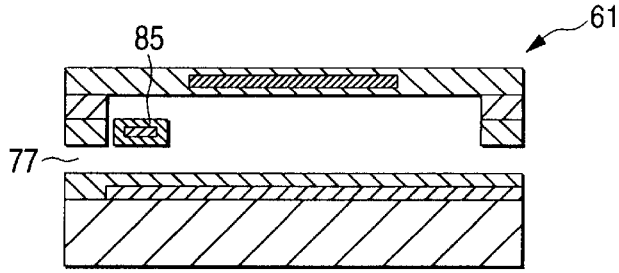
FIGS. 8(*a*)–(*e*) are sectional views for explaining the operation of the ink-jet head according to the second embodiment of the present invention.
Figure 8:
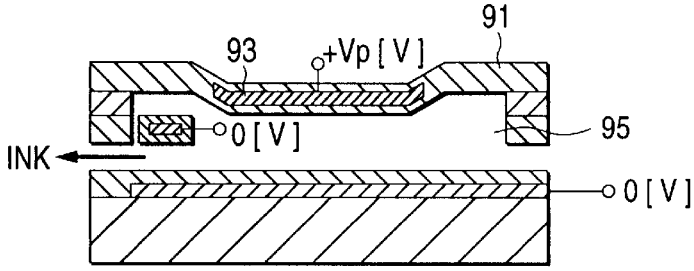
Figure 8:
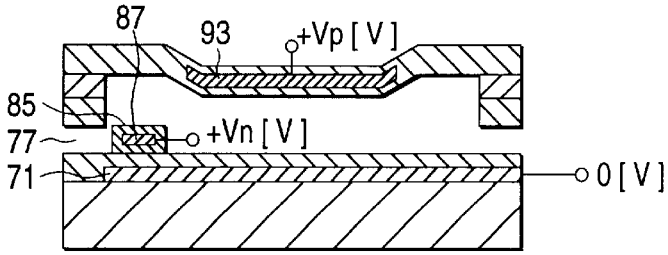
Figure 8:
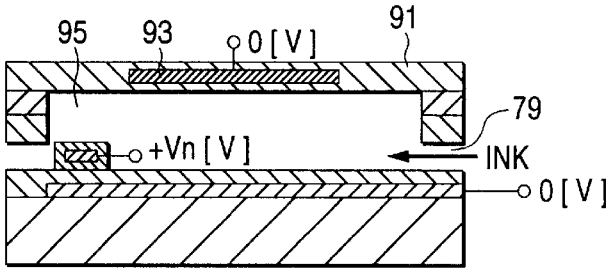
Figure 8:
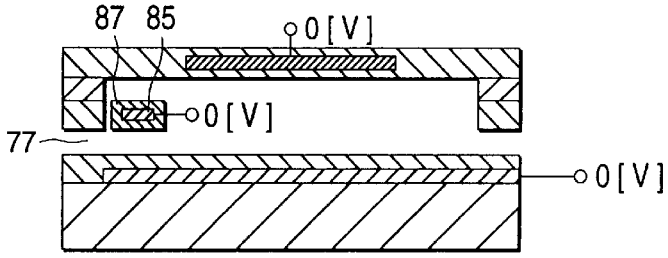
Figure 9:
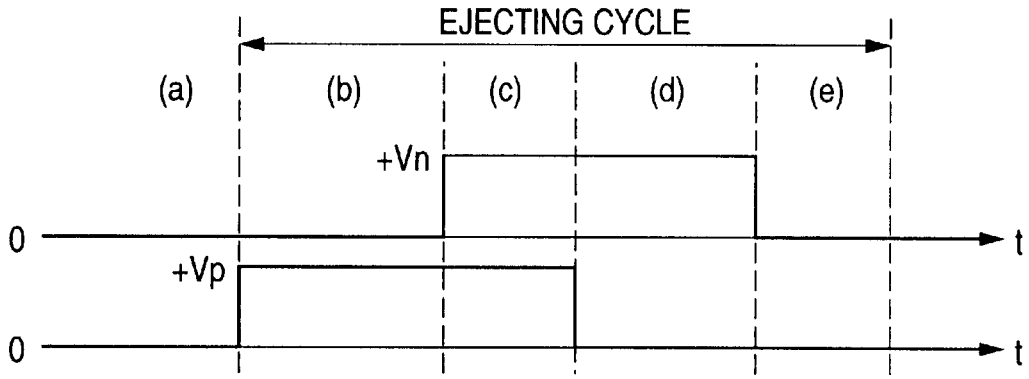
FIG. 9 is a time chart showing the driving timing of the ink-jet head according to the second embodiment of the present invention.

FIGS. 8(*a*) to (*e*) are sectional views for explaining the operation of the ink-jet head according to the second embodiment of the present invention and FIG. 9 is a time chart showing timing for driving the ink-jet head according to the second embodiment of the present invention.

In an unoperated state shown in FIG. 8(*a*) of the ink-jet head 61, the ejection port valve plate 85 is located in the upper part of the inside opening of the ejection port 77 and the ejection port 77 is open.

When voltage $+V_p$ is applied to the pressurizing electrode 93 as shown (b) in FIG. 9 in the unoperated state, the pressurizing plate 91 is bent on the side of the ink chamber 95 as shown in FIG. 8(*b*). Hereby, pressure in the ink chamber 95 is increased and ink in the ink chamber 95 is ejected from the ejection port 77 as an ink droplet.

Next, voltage $+V_n$ is applied to the ejection port valve electrode 87 as shown (c) in FIG. 9 with voltage applied to the pressurizing electrode 93. Hereby, as shown in FIG. 8(*c*), the ejection port valve plate 85 is bent on the side of the common electrode 71 by electrostatic force and closes the inside opening of the ejection port 77. At this time, the ejection port valve plate 85 is moved approximately perpendicularly to a direction in which ink is ejected from the ejection port 77.

When voltage to the pressurizing electrode 93 is turned off as shown (d) in FIG. 9 with voltage applied to the ejection port valve electrode 87 in the above state, the pressurizing plate 91 is elastically restored as shown in FIG. 8(*d*), the ink chamber 95 is decompressed and ink flows into the ink chamber 95 from the ink supply port 79.

Next, when voltage to the ejection port valve electrode 87 is turned off as shown (e) in FIG. 9, the ejection port valve plate 85 is elastically restored as shown in FIG. 8(*e*) and the ejection port 77 is opened to get ready for ejecting the next ink droplet.

As described above, according to the ink-jet head 61 according to this embodiment, as the ejection port valve plate 85 for opening or closing the ejection port 77 is provided, ink can be efficiently supplied from the reservoir by closing the ejection port 77 when ink is supplied. As a result, an ejecting cycle can be reduced and high speed ejecting is enabled.

Also, according to the above constitution, when the ink chamber 95 is pressurized and the ejection port valve plate 85 is closed, high speed operation by the action of electrostatic force (attractive force) is enabled. When the ink chamber 95 is decompressed and the ejection port valve plate 85 is opened, high speed operation by the action of electrostatic force (repulsive force) and the elastic restorative force of the material is also enabled. Efficient operation with low voltage is enabled by suitably designing the shape and the material of a deformed part of the pressurizing plate 91 and the ejection port valve plate 85 and an interval between the electrodes dynamically and electrostatically.

Also, as the above constitution is simple laminated structure, the ink-jet head according to the second embodiment can be readily manufactured. That is, after the substrate part 63, the valve part 65 and the cover part 67 respectively shown in FIG. 7 are processed in a photolithographic process and by etching, they may be also bonded, after the substrate part 63 and the valve part 65 are integrated, the cover part 67 may be also bonded to it and further, the ink-jet head according to the second embodiment can be also manufactured by integrating all parts. As a result, the above ink-jet head can be readily manufactured and the manufacturing cost can be reduced.

Figure 10:
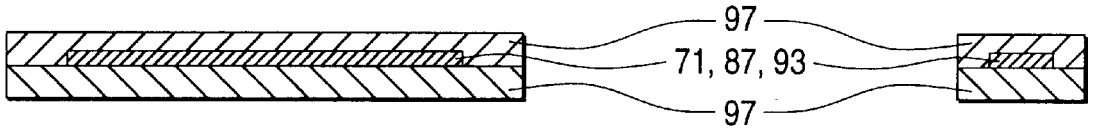
FIG. 10 is a sectional view showing the structure of the ejection port valve plate shown in FIG. 4.

It is desirable that the common electrode 71, the ejection port valve electrode 87 and the pressurizing electrode 93 are generally made of metal, however, they may be also made of a semiconductor in which high density impurities are doped. Further, it is desirable that these electrodes 71, 87 and 93 are covered with an insulating film 97 made of a silicon oxide film, a silicon nitride film, glass such as PSG or polyimide and others as shown in FIG. 10 to protect the electrodes.

Although the following mechanical stopper is not shown, it is provided to the ink jet head 61 in a desired position to stabilize the quantity of deformation by electrostatic force and the quantity of the deformation of the ejection port valve plate 85 and the pressurizing plate 91 may be also regulated so that the above quantity is fixed.

In addition, the position and the structure of the ink supply port 79 may be suitably determined. Further, the supply port valve has only to be mechanically deformed or moved with electrostatic force (attractive force or repulsive force) in addition to the above structure, and for example, may be also the supply port valve plate 85 provided with cantilever structure, an electrostatic band-like actuator-type valve and an electrostatic rotary valve.

Next, various modified examples of the second embodiment will be described. These modified examples are provided with the ejection port valve plate which is the main part of the constitution according to the second embodiment in common.

Figure 11:
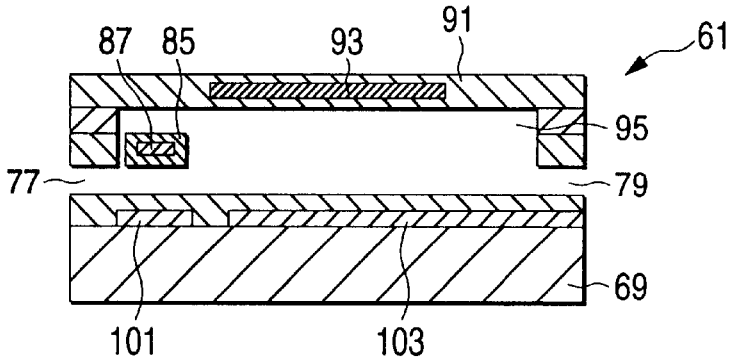
FIG. 11 is a sectional view showing a first modified example of the second embodiment.

First, referring to FIG. 11, a first modified example of the second embodiment will be described. FIG. 11 is a sectional view showing the first modified example of the second embodiment.

In the first modified example, a common electrode is separated, a valve opposite electrode 101 opposite to the ejection port valve electrode 87 and a pressurizing plate opposite electrode 103 opposite to the pressurizing electrode 93 are independently formed.

According to such a first modified example, electric field crosstalk between electrodes can be reduced and the ink-jet head can be more precisely operated.

Figure 12:
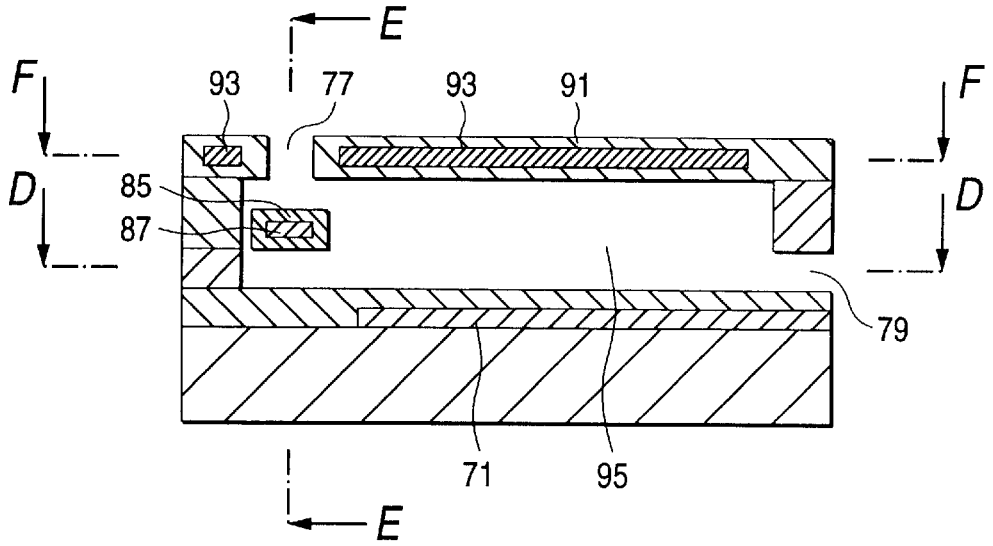
FIG. 12 is a sectional view showing a second modified example of the second embodiment.
Figure 13:
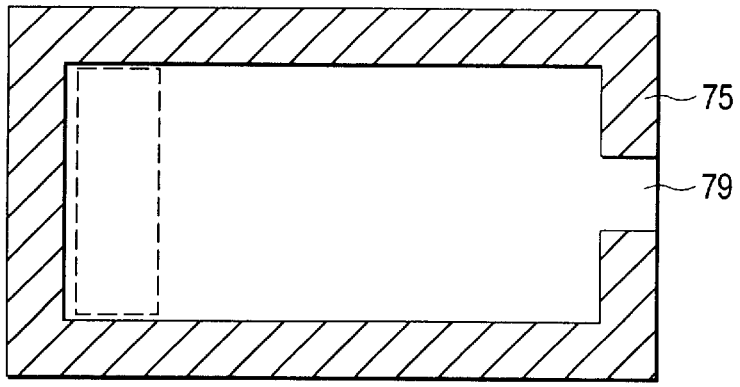
FIG. 13 is a drawing viewed along a line D—D in FIG. 12.
Figure 14:
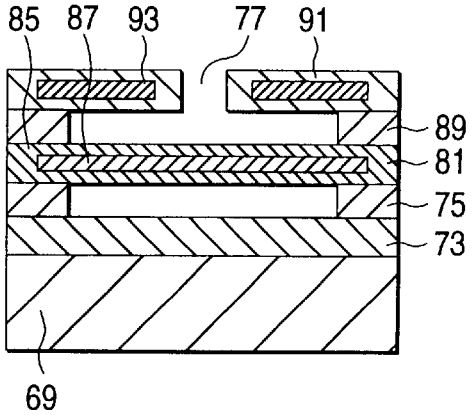
FIG. 14 is a drawing viewed along a line E—E in FIG. 12.
Figure 15:
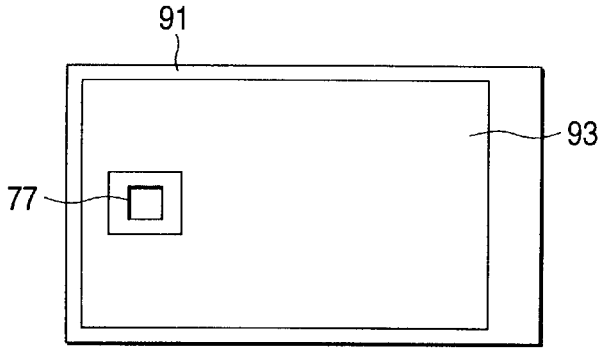
FIG. 15 is a drawing viewed along a line F—F in FIG. 12.

Next, referring to FIGS. 12 to 16, a second modified example of the second embodiment will be described. FIG. 12 is a sectional view showing the second modified example of the second embodiment, FIG. 13 is a drawing viewed along a line D—D in FIG. 12, FIG. 14 is a drawing viewed along a line E—E in FIG. 12, FIG. 15 is a drawing viewed along a line F—F in FIG. 12 and FIG. 16 is a sectional view for explaining the operation in the second modified example of the second embodiment.

In the second modified example, only an ink supply port 79 is formed in a first peripheral wall 75. A ejection port 77 is formed in a pressurizing plate 91. A ejection port valve plate 85 formed in a frame 81 is arranged in the lower part of the inside opening of the ejection port 77 in the ink chamber 95. A pressurizing electrode 93 is formed in the pressurizing plate 91 and an ejection port valve electrode 87 is formed in the ejection port valve plate 85.

Figure 16:
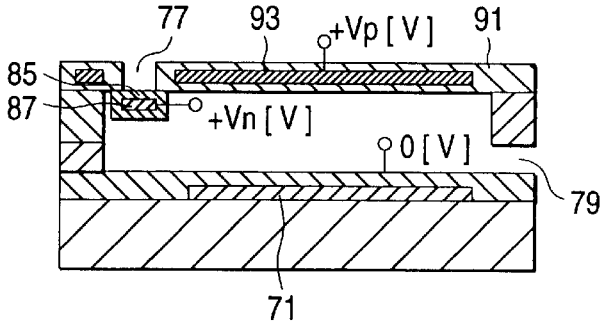
FIG. 16 is a sectional view for explaining the operation of the second modified example of the second embodiment.

The ejection port valve plate 85 is bent in the direction of the pressurizing plate 91 by electrostatic force by applying voltage to the ejection port valve electrode 87 to close the inside opening of the ejection port 77 as shown in FIG. 16. That is, in the second modified example, the ejection port valve plate 85 is moved approximately in parallel to a direction in which ink is ejected from the ejection port 77.

According to such a second modified example, the passage resistance of the ejection port 77 can be enhanced or the ejection port 77 can be closed by bending and moving the ejection port valve plate 85 by electrostatic force in a direction of the pressurizing plate 91. As the upper surface of the ejection port valve plate 85 is brought into contact with the ejection port 77 and closes it, the ejection port 77 with a relatively large diameter can be opened or closed.

In another modified example in addition to the second modified example, the position and the structure of the ejection port 77 may be also suitably determined. Further, an ejecting valve has only to be mechanically deformed or moved with electrostatic force (attractive force and repulsive force) in addition to the above structure, and for example, may be also an ejection port valve plate provided with cantilever structure, an electrostatic band-like actuator-type valve and an electrostatic rotary valve.

Figure 17:
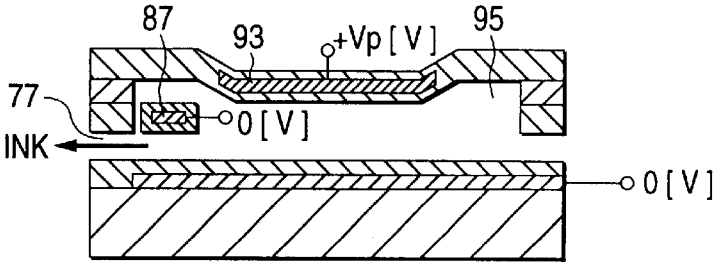
FIGS. 17(*a*) and (*b*) are sectional views for explaining the operation in a third modified example of the second embodiment.
Figure 17:
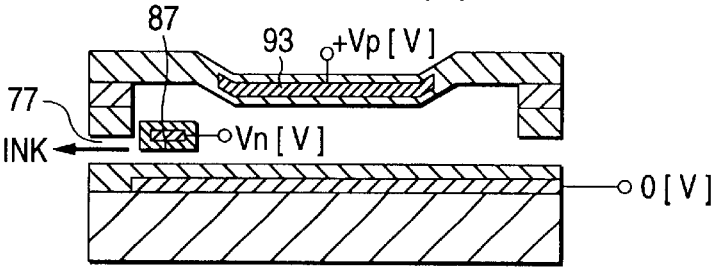

Next, referring to FIGS. 17(*a*) and (*b*), a third modified example of the second embodiment will be described. FIGS. 17(*a*) and (*b*) are sectional views for explaining the operation in the third modified example of the second embodiment.

In the ink-jet head 61 described in the second embodiment, ink in the ink chamber 95 is ejected from the ejection port 77 with the ejection port 77 completely open by applying voltage to only the pressurizing electrode 93 the without applying voltage to the ejection port valve electrode 87 when ink is ejected. Therefore, in this case, as the passage resistance of the ejection port 77 is minimum, the quantity of ejected ink becomes maximum.

In the meantime, in an ink-jet head according to the third modified example, if voltage applied to a pressurizing electrode 93 is fixed and pressurized time is fixed, the numerical aperture of an ejection port 77 is arbitrarily varied by applying suitable voltage to an ejection port valve electrode 87.

Therefore, the quantity of ejected ink can be controlled so that it is desired quantity by applying suitable voltage $V_{n1}$ to the ejection port valve electrode 87 as shown in FIG. 17(*b*) when an ink chamber 95 is pressurized and suitably controlling the numerical aperture of the ejection port 77.

According to a method of driving the ink-jet head in such a third modified example, the quantity of ejected ink can be arbitrarily and precisely controlled by changing the numerical aperture of the ejection port 77 and the control of gradation is enabled.

In the driving method in the third modified example, means for controlling the quantity of ink may be also combined by changing voltage and time applied to the pressurizing electrode 93 and in this case, the more precise control of gradation is enabled.

Figure 18:
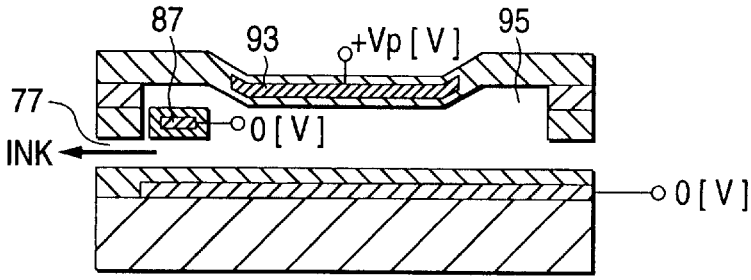
FIGS. 18(*a*) and (*b*) are sectional views for explaining the operation in a fourth modified example of the second embodiment.
Figure 18:
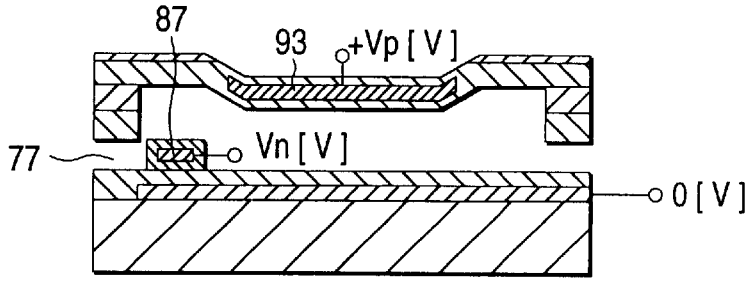

Next, referring to FIGS. 18(*a*), (*b*) and 19, a fourth modified example of the second embodiment will be described. FIGS. 18(*a*) and (*b*) are sectional views for explaining the operation in the fourth modified example of the second embodiment and FIG. 19 is a time chart showing the driving timing in the fourth modified example of the second embodiment.

In the control of gradation in the above third modified example, the quantity of ejected ink is varied by changing the numerical aperture of the ejection port 77 with the ejection port valve plate 85 to control gradation, however, in the case of the fourth modified example, the quantity of ejected ink is varied by controlling time in which an ejection port valve plate 85 is opened or closed and the control of gradation is enabled.

Figure 19:
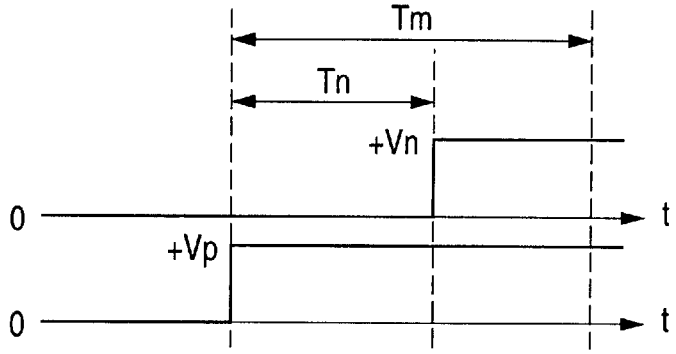
FIG. 19 is a time chart showing the driving timing in the fourth modified example of the second embodiment.

That is, when the ejecting of ink is started as shown in FIG. 19, voltage $+V_p$ is applied to only a pressurizing electrode 93 without applying voltage to an ejection port valve electrode 87 and ink is ejected from an ejection port 77 completely open. At this time, the ejection port 77 is closed as shown in FIG. 18(*b*) by applying voltage $+V_n$ to the ejection port valve electrode 87 after arbitrary time $T_n$ elapses since pressurization is started.

As shown in FIG. 19, $T_m$ shows maximum time in which ink is ejected and $T_n$ shows time since ink is ejected by pressurization until the ejection port 77 is closed and the ejecting of ink is halted. Therefore, the quantity of ejected ink is precisely and arbitrarily controlled by changing $T_n$ in a range of "$0 \leqq T_n \leqq T_m$" and the control of gradation is enabled.

In the driving method in the fourth modified example, means for controlling the quantity of ink may be also combined by changing voltage applied to the pressurizing electrode 93 or voltage applied to the ejection port valve electrode 87 and in this case, the more precise control of gradation is enabled.

Figure 20:
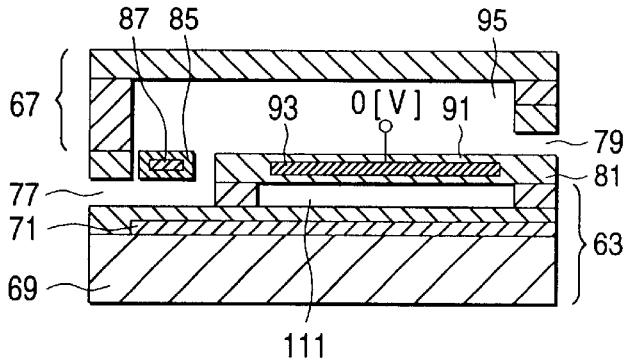
FIGS. 20(*a*) to (*e*) are sectional views for explaining the operation in a fifth modified example of the second embodiment.
Figure 20:
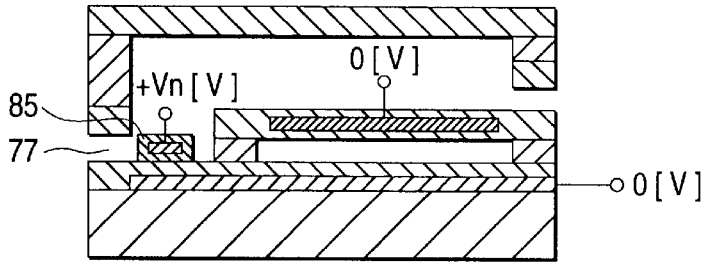
Figure 20:
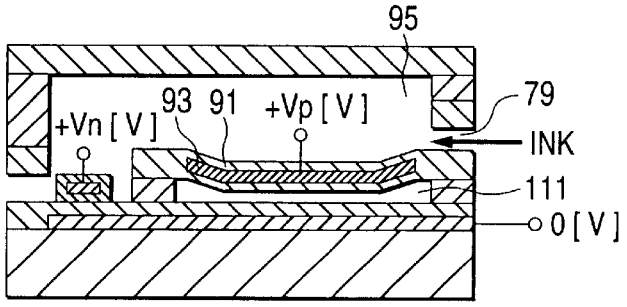
Figure 20:
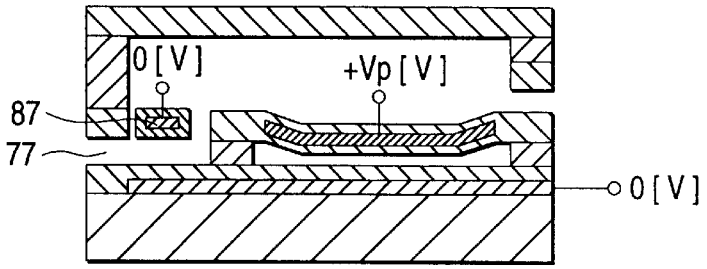
Figure 20:
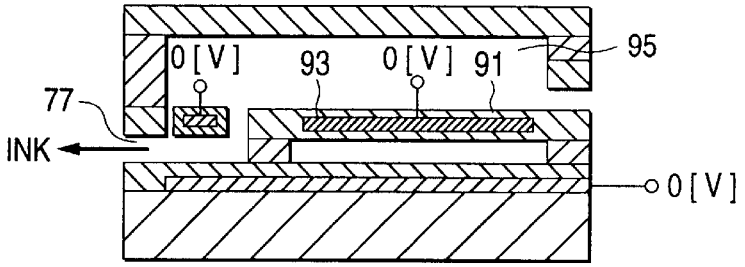
Figure 21:
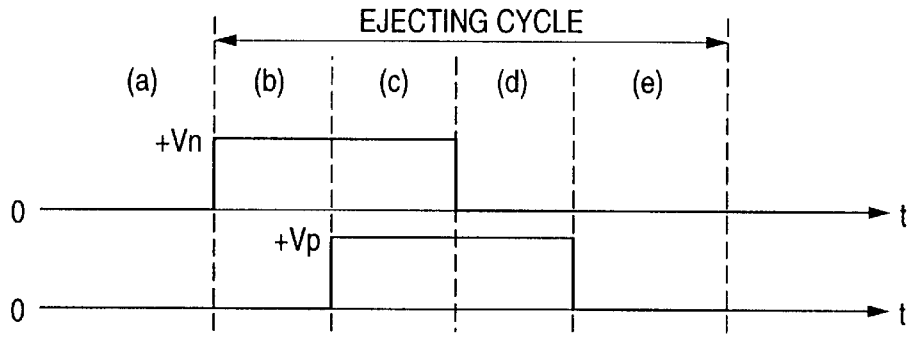
FIG. 21 is a time chart showing the driving timing in the fifth modified example of the second embodiment.

Next, referring to FIGS. 20(*a*) to 21, a fifth modified example of the second embodiment will be described. FIGS. 20 are sectional views for explaining the operation in the fifth modified example of the second embodiment and FIG. 21 is a time chart showing the driving timing in the fifth modified example of the second embodiment.

In an ink-jet head in the modified example, a pressurizing plate 91 is provided inside an ink chamber 95 as shown in FIG. 20(*a*) and a cavity 111 to be flexible space of the pressurizing plate 91 is formed between the pressurizing plate 91 and a common electrode 71. In the modified example, the pressurizing plate 91 may be formed in a frame 81 of a valve part 65.

In the ink-jet head constituted as described above, the pressurizing plate 91 can be provided close to the common electrode 71. Therefore, the pressurizing plate 91 is not required to be provided to the cover part 65 by providing the pressurizing plate 91 inside the ink chamber 95 and the cover part 67 has only to be formed only as a cover for sealing the ink chamber 95.

The operation of the ink-jet head constituted as described above will be described below.

As shown in FIG. 20(*a*), in an unoperated state, no voltage is applied to the ejection port valve electrode 87 and the pressurizing electrode 93 and the ejection port 77 is completely opened.

In this state, voltage $+V_n$ is applied to the ejection port valve electrode 87 as shown (b) in FIG. 21 and the ejection port valve plate 85 is bent as shown in FIG. 20(*b*) to close the ejection port 77.

Next, voltage $+V_p$ is applied to the pressurizing electrode 93 as shown (c) in FIG. 21 with voltage applied to the ejection port valve electrode 87. Hereby, the pressurizing plate 91 is bent on the side of the cavity 111 as shown in FIG. 20(*c*) and the ink chamber 95 is decompressed. When the ink chamber 95 is decompressed, ink is supplied to the ink chamber 95 from an ink supply port 79.

Next, the ejection port 77 is opened as shown in FIG. 20(*d*) by turning off the voltage of the ejection port valve electrode 87 as shown (d) in FIG. 21.

Next, the pressurizing plate 91 is elastically restored in a direction in which pressure in the ink chamber 95 is increased as shown in FIG. 20(*e*) by turning off the voltage of the pressurizing electrode 93 as shown (e) in FIG. 21 and hereby, ink in the ink chamber 95 is ejected from the ejection port 77.

According to the ink-jet head in the fifth modified example, all the electrodes 71, 87 and 93 and the deforming plates can be formed in the same substrate part 63. Therefore, the relative position of the movable parts can be precisely manufactured.

As an interval between the pressurizing electrode 93 and the common electrode 71 can be reduced, driving with lower voltage is enabled.

Figure 22:
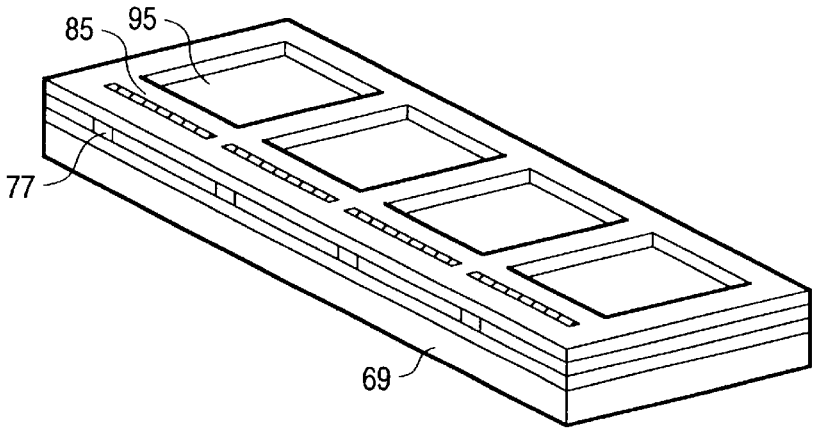
FIG. 22 is a perspective drawing showing a multi-nozzle part in a sixth modified example of the second embodiment.
Figure 23:
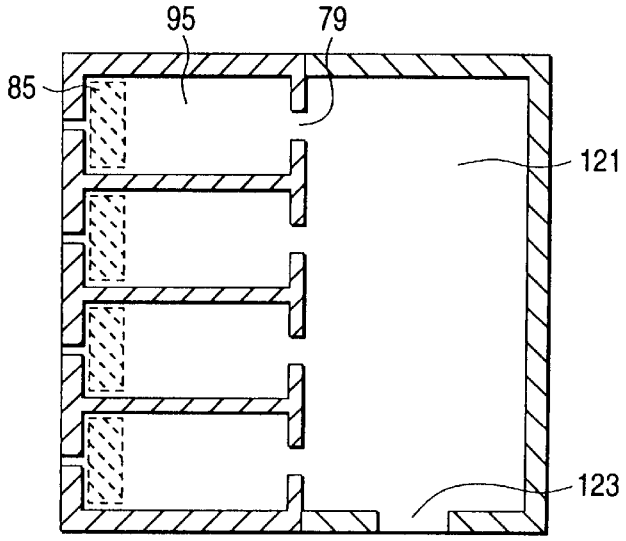
FIG. 23 is a plan view showing the inside of a multi-nozzle head in the sixth modified example of the second embodiment.

Next, referring to FIGS. 22 to 24(*d*), a sixth modified example of the second embodiment will be described. FIG. 22 is a perspective drawing showing a multi-nozzle part in the sixth modified example of the second embodiment, FIG. 23 is a plan view showing the inside of a multi-nozzle head in the sixth modified example of the second embodiment and FIG. 24 is a plan view showing the inside of the multi-nozzle head for explaining the operation in the sixth modified example of the second embodiment.

In the modified example, plural ink chambers 95 are arranged on a substrate 69, and the above ejection port valve plate 85 and the above pressurizing plate 91 are provided to each ink chamber 95. A reservoir 121 communicates with an ink supply port 79 of each ink chamber 95. A port 123 for connecting to an ink cartridge is provided to the reservoir 121 and the ink cartridge not shown is connected to the port 123 for connecting to the ink cartridge.

The operation of the ink-jet head (the multi-nozzle ink-jet head) constituted as described above will be described below.

Figure 24:
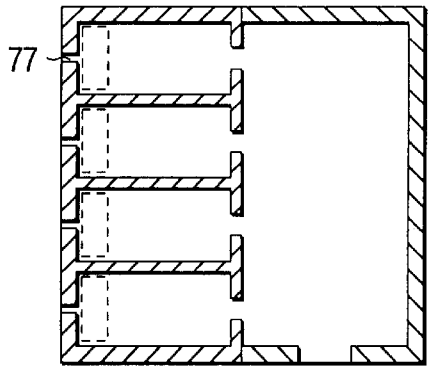
FIGS. 24(*a*) to (*d*) are plan views showing the inside of the multi-nozzle head for explaining the operation in the sixth modified example of the second embodiment.
Figure 24:
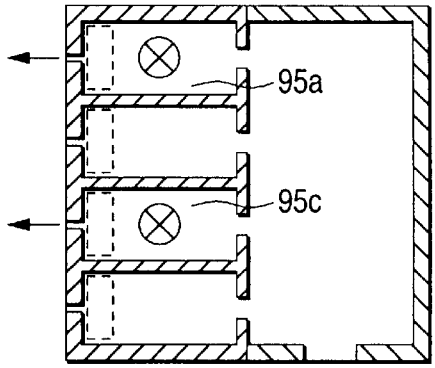
Figure 24:
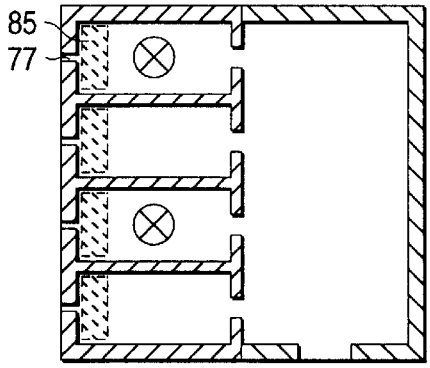
Figure 24:
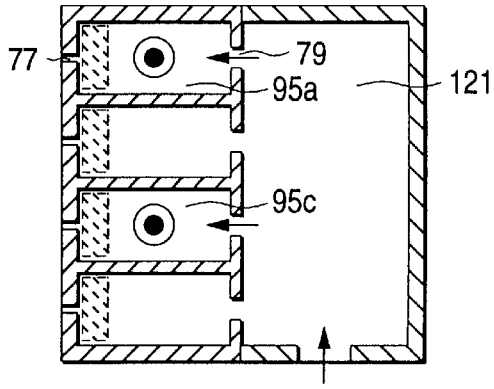

First, as shown in FIG. 24(*a*), all the ejection ports 77 are opened and ink is ejected by pressurizing arbitrary ink chambers 95*a* and 95*c* as shown in FIG. 24(*b*) in this state.

Next, all the ejection ports 77 are closed by bending the ejection port valve plate 85 as shown in FIG. 24(*c*).

Next, voltage to each pressurizing electrode 93 of the pressurized ink chambers 95*a* and 95*c* is turned off with the ejection port 77 closed as shown in FIG. 24(*d*), the pressurized ink chambers 95 are decompressed by elastically restoring each pressurizing plate 91 and ink is supplied from the reservoir 121 via the ink supply port 79.

The multi-nozzle head portion can be integrated by photolithography, etching and others. The whole head is manufactured by bonding the reservoir 121 separately manufactured to the above multi-nozzle head portion, however, the multi-nozzle head portion and the reservoir 121 may be also manufactured by integrating them.

As all the ejection ports 77 are closed in the multi-nozzle ink-jet head when ink is supplied, ink can be supplied efficiently at high speed without the loss of ink suction pressure when ink is supplied by reduced pressure.

As ink is sucked from the reservoir 121 by common reduced pressure, ink supply capacity can be fixed independent of the number of nozzles and stable ink supply is enabled.

All the ink supply ports 79 are closed in FIGS. 24(*a*) and 24(*b*), however, only the ink supply ports 79 of the ink chambers 95*a* and 95*c* from which ink is ejected may be also closed.

The ink supply ports 79 of the pressurized ink chambers 95*a* and 95 are opened in FIGS. 24(*c*) and 24(*d*), however, after all the ink supply ports 79 are opened, the ink chamber 95 may be also decompressed to supply ink.

Next, an ink-jet head according to a third embodiment of the present invention will be described.

Figure 25:
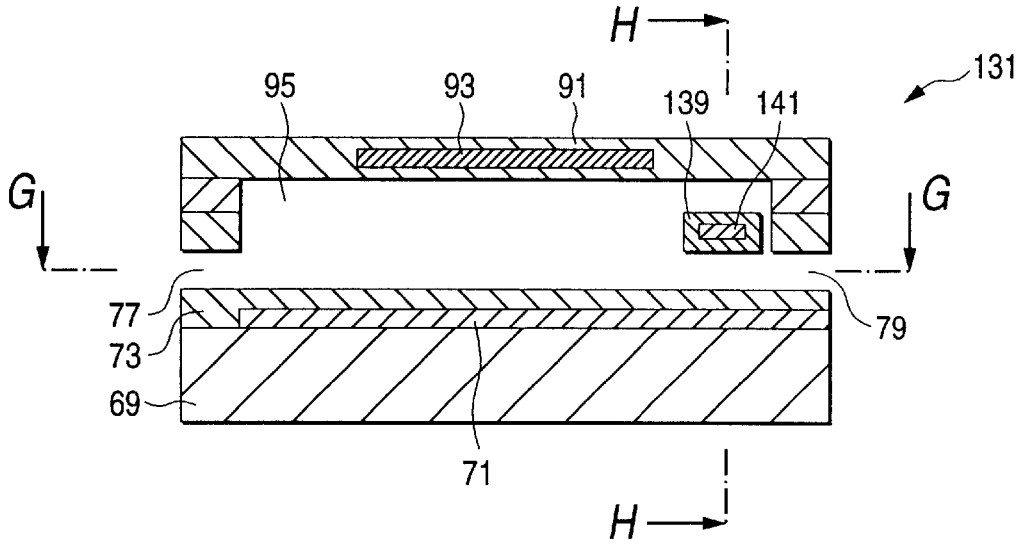
FIG. 25 is a sectional view showing an ink-jet head according to a third embodiment of the present invention.
Figure 26:
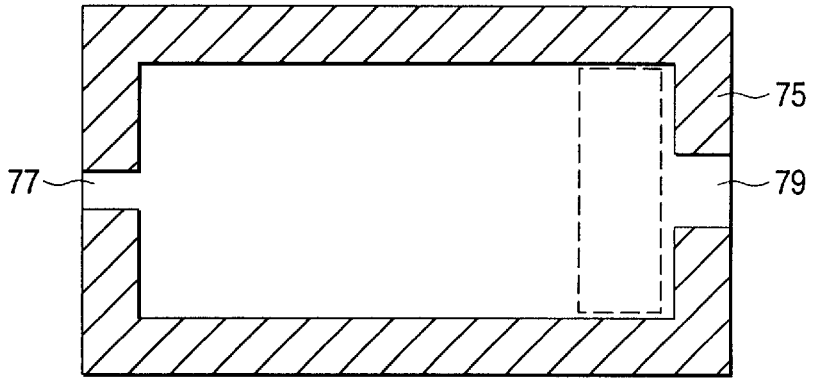
FIG. 26 is a drawing viewed along a line G—G in FIG. 25.
Figure 27:
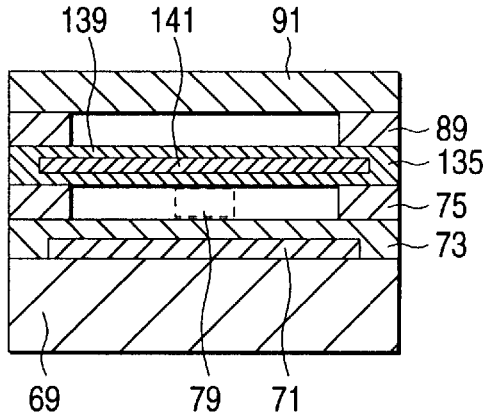
FIG. 27 is a drawing viewed along a line H—H in FIG. 25.
Figure 28:
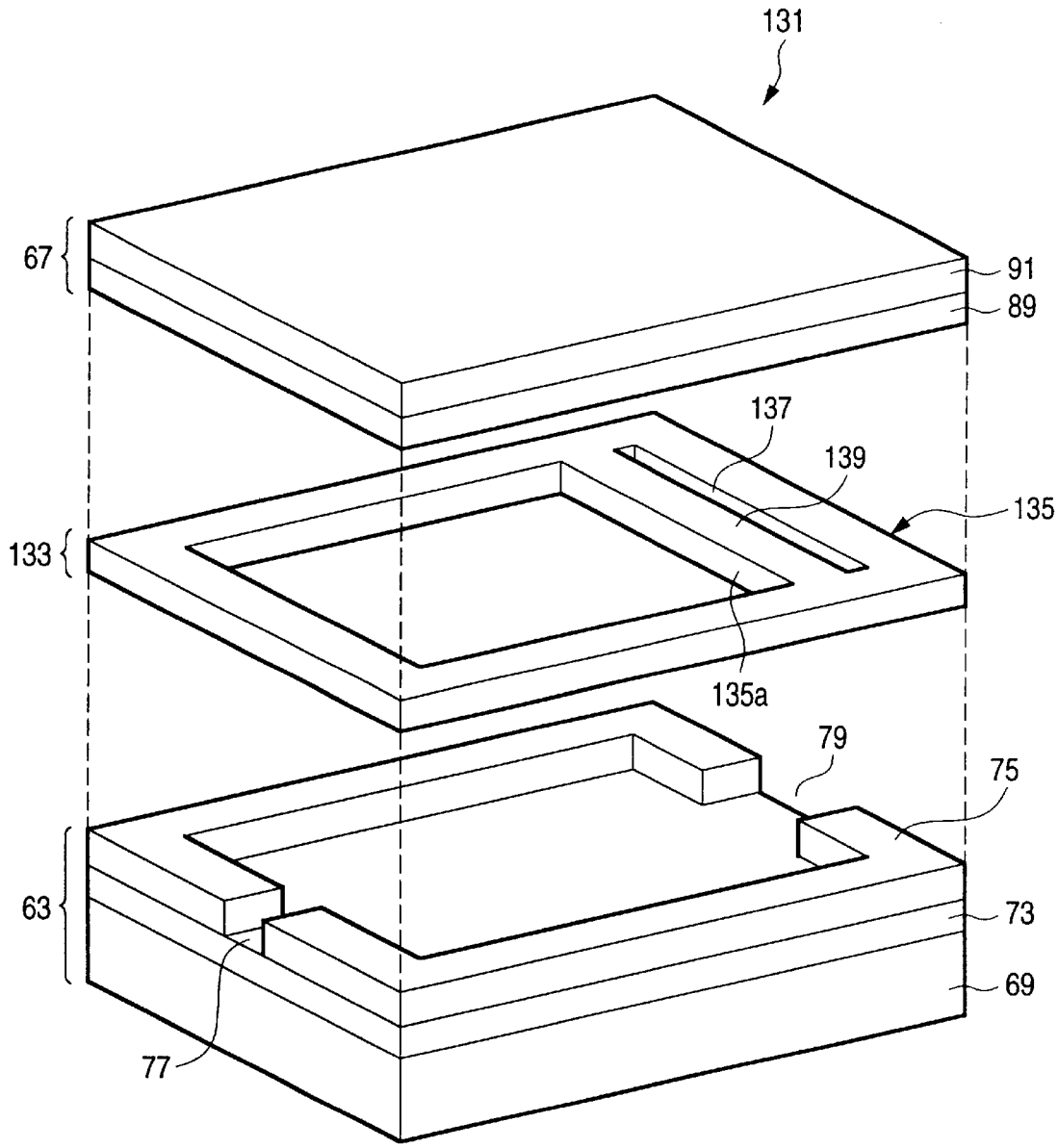
FIG. 28 is an exploded perspective drawing showing the ink-jet head in FIG. 25.

FIG. 25 is a sectional view showing the ink-jet head according to the third embodiment of the present invention, FIG. 26 is a drawing viewed along a line G—G in FIG. 25, FIG. 27 is a drawing viewed along a line H—H in FIG. 25 and FIG. 28 is an exploded perspective drawing showing the ink-jet head in FIG. 25.

The main part of the ink-jet head 131 according to the third embodiment is composed of a substrate part 63, a valve part 133 and a cover part 67. The substrate part 63 is further composed of a substrate 69, a common electrode 71, an electrode protecting layer 73 and a first peripheral wall 75. The common electrode 71 is formed on the substrate 69 and is covered with the insulating electrode protecting layer 73 formed over the substrate 69.

The first peripheral wall 75 in the shape of a rectangular frame is formed on the upper surface of the electrode protecting layer 73. A ejection port 77 is formed in one of parallel opposite walls of the first peripheral wall 75 and an ink supply port 79 is formed in the other.

The valve part 133 is composed of a frame 135 in the approximately same shape as the first peripheral wall 75. The frame 135 is bonded to the upper end face of the first peripheral wall 75. A slit 137 is formed in the vicinity of one end of the frame 135 associated with the ink supply port 79. A flexible member (a supply port valve plate) 139 both ends of which are supported is formed between the slit 137 and an inner hole 135*a* in the frame 135 by forming the slit 137. The supply port valve plate 139 is located in the upper part of the inside opening of the ink supply port 79 by laminating the frame 135 on the first peripheral wall 75. Inside the supply port valve plate 139, a supply port valve electrode 141 which is dielectrics is formed.

The cover part 67 is laminated on the upper surface of the frame 135. The cover part 67 is composed of a second peripheral wall 89 and an elastic pressurizing plate 91. The second peripheral wall 89 is a rectangular frame in the approximately same shape as the first peripheral wall 75. The pressurizing plate 91 is laminated on the upper surface of the second peripheral wall 89. A pressurizing electrode 93 is formed inside the pressurizing plate 91.

Therefore, an ink chamber 95 surrounded by the first peripheral wall 75, the frame 81 and the second peripheral wall 89 is formed between the electrode protecting layer 73 and the pressurizing plate 91. The ink chamber 95 has fluid-tight structure with only the ejection port 77 and the ink supply port 79 respectively formed in the first peripheral wall 75 open. The ink chamber 95 is connected to a reservoir not shown via the ink supply port 79.

In the ink-jet head 131 constituted as described above, as in the above first embodiment, the substrate 69 can be formed by a resin film such as polyethylene terephthalate and polycarbonate, metallic oxide, an inorganic insulator such as a ceramic or a semiconductor in addition to a transparent glass plate. The common electrode 71, the supply port valve electrode 141 and the pressurizing electrode 93 can be formed by metal or a metallic compound having conductivity. In this case, for metal, gold, silver, palladium, zinc, aluminum and others may be used and for a metallic compound, iridium oxide, zinc oxide, aluminum oxide and others may be used.

Figure 29:
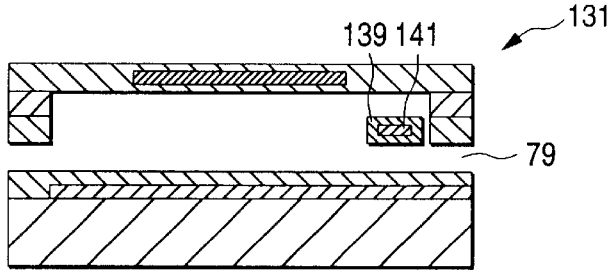
FIGS. 29(*a*) to (*e*) are sectional views for explaining the operation of the ink-jet head according to the third embodiment of the present invention.
Figure 29:
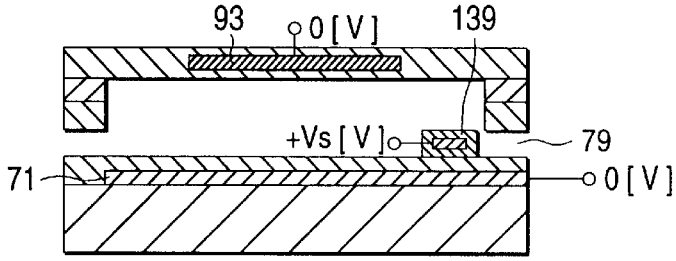
Figure 29:
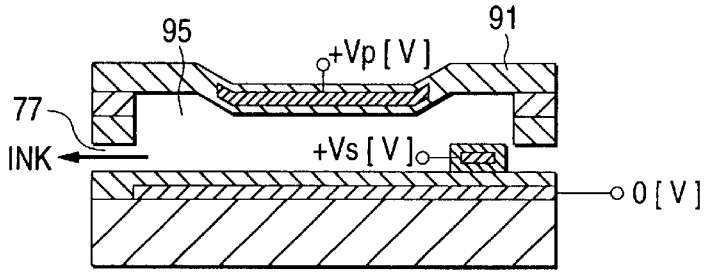
Figure 29:
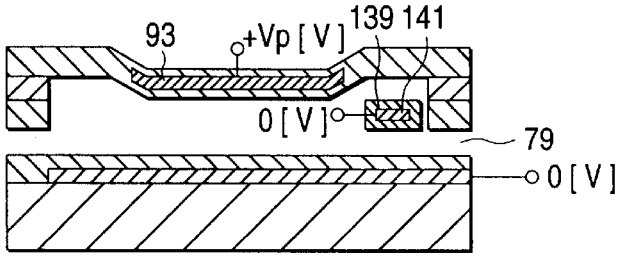
Figure 29:
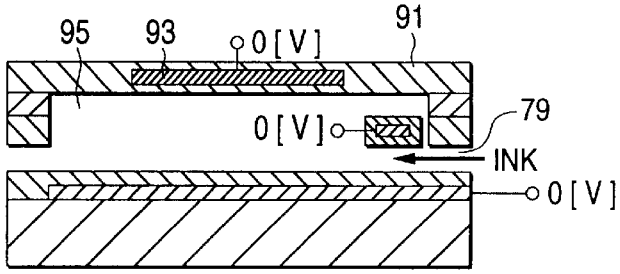

Next, the operation of the ink-jet head 131 constituted as described above will be described. FIGS. 29(*a*) to (*e*) are sectional views for explaining the operation of the ink-jet head according to the third embodiment of the present invention and FIG. 30 is a time chart showing the driving timing of the ink-jet head according to the third embodiment of the present invention.

In the ink-jet head 131, in an unoperated state shown in FIG. 29(*a*), the supply port valve plate 139 is located in the upper part of the inside opening of the ink supply port 79 and the ink supply port 79 is open.

Figure 30:
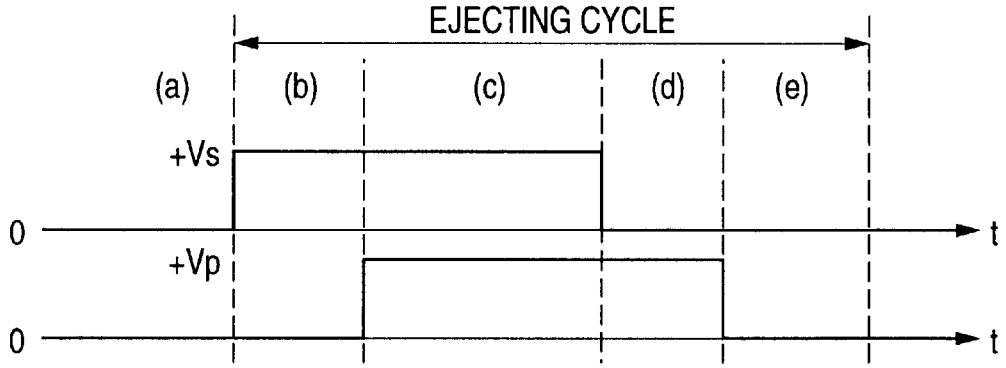
FIG. 30 is a time chart showing the driving timing of the ink-jet head according to the third embodiment of the present invention.

When voltage $+V_s$ is applied to the supply port valve electrode 141 as shown (b) in FIG. 30 in the unoperated state, the supply port valve plate 139 is bent on the side of the common electrode 71 by electrostatic force as shown in FIG. 29(*b*) and closes the inside opening of the ink supply port 79.

Next, when voltage $+V_p$ is applied to the pressurizing electrode 93 as shown (c) in FIG. 30, the pressurizing plate 91 is bent on the side of the ink chamber 95 by electrostatic force as shown in FIG. 29(*c*). Hereby, pressure in the ink chamber 95 is increased and ink in the ink chamber 95 is ejected from the ejection port 77 as an ink droplet.

Next, when voltage to the supply port valve electrode 141 is turned off as shown (d) in FIG. 30 with voltage applied to the pressurizing electrode 93, the supply port valve plate 139 is elastically restored as shown in FIG. 29(*d*) and the ink supply port 79 is released.

Next, when voltage to the pressurizing electrode 93 is turned off as shown (e) in FIG. 30, the pressurizing plate 91 is elastically restored as shown in FIG. 29(*e*), the ink chamber 95 is decompressed, ink flows into the ink chamber 95 from the ink supply port 79 and the ink chamber is ready for ejecting the next ink droplet.

As described above, according to the ink-jet head 131 according to this embodiment, as the supply port valve plate 139 for opening or closing the ink supply port 79 is provided, pressurized ink can be efficiently ejected by closing the ink supply port 79 when ink is ejected. As a result, an ejecting cycle can be reduced and high speed ejecting is enabled.

As the ink supply port 79 can be closed by the supply port valve plate 139, the large ink supply port 79 can be formed, passage resistance when ink is supplied is reduced and ink supply time can be reduced. Hereby, stable high speed ink ejecting is also enabled.

According to such constitution, when the ink chamber 95 is pressurized and when the supply port valve plate 139 is closed, high speed operation by the action of electrostatic force (attractive force) is enabled. When the ink chamber 95 is decompressed and when the supply port valve plate 139 is opened, high speed operation by the action of electrostatic force (repulsive force) and the elastic restorative force of the material is enabled. The pressurizing plate 91 and the supply port valve plate 139 can be efficiently operated with low voltage by suitably designing the shape and the material of the deformed part and an interval between the electrodes dynamically and electrostatically.

Also, according to such constitution, the ink-jet head can be readily manufactured because of simple laminated structure. That is, after the substrate part 63, the valve part 133 and the cover part 67 respectively shown in FIG. 28 are processed by photolithography and etching, they may be also bonded, after the substrate part 63 and the valve part 133 are integrated, the cover part 67 may be also bonded to them and further, the ink-jet head can be also manufactured by integrating all the parts. As a result, easy manufacture is enabled and the manufacturing cost can be reduced.

It is desirable that the common electrode 71, the supply port valve electrode 141 and the pressurizing electrode 93 are generally made of metal, however, they may be also made of a semiconductor in which high density impurities are doped. Further, it is desirable that these electrodes 71, 141 and 93 are covered with an insulating film made of a silicon oxide film, a silicon nitride film, glass such as PSG, polyimide and others to protect each electrode.

Although the following mechanical stopper is not shown, it is provided to the ink jet head 131 in a desired position to stabilize the quantity of deformation by electrostatic force and the quantity of the deformation of the supply port valve plate 139 and the pressurizing plate 91 may be also regulated so that the above quantity is fixed.

In the ink-jet head 131, as in the second embodiment, the common electrode is separated and respectively opposite electrodes to the pressurizing electrode 93 and the supply port valve electrode 141 may be also independently provided. Hereby, electric field crosstalk between the electrodes can be reduced and the ink-jet head can be more precisely operated.

In the ink-jet head 131, only the ejection port 77 is formed in the first peripheral wall 75 and the ink supply port 79 may be also formed in the pressurizing plate 91. In this case, the supply port valve plate 139 of the frame 135 is arranged in the lower part of the inside opening of the ink supply port 79 in the ink chamber 95, is bent in the direction of the pressurizing plate 91 by electrostatic force and closes the inside opening of the ink supply port 79. As described above, the supply port valve plate 139 may be also moved approximately in parallel to a direction in which ink from the ink supply port 79 is ejected.

In addition, the position and the structure of the ink supply port 79 may be suitably determined. Further, the supply port valve has only to be mechanically deformed or moved with electrostatic force (attractive force or repulsive force) in addition to the above structure, and for example, may be also the supply port valve plate 139 provided with cantilever structure, an electrostatic band-like actuator-type valve and an electrostatic rotary valve.

Next, various modified examples of the third embodiment will be described. These modified examples are provided with the supply port valve plate which is the main part of the constitution in the third embodiment in common.

Figure 31:
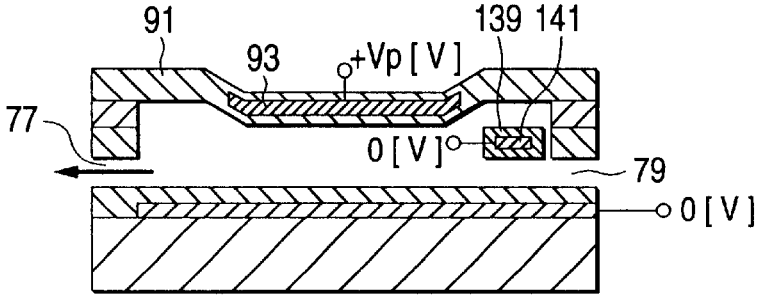
FIGS. 31(*a*) and (*b*) are sectional views for explaining the operation in a first modified example of the third embodiment.
Figure 31:
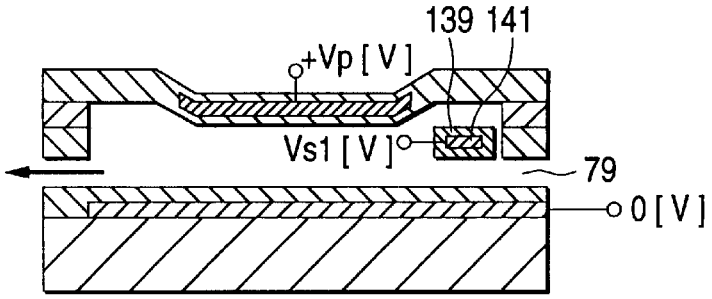

First, referring to FIGS. 31(*a*) and (*b*), a first modified example of the third embodiment will be described. FIGS. 31(*a*) and (*b*) are sectional views for explaining the operation in the first modified example of the third embodiment.

In the ink-jet head 131 described in the third embodiment, ink in an ink chamber 95 is ejected from an ejection port 77 by applying voltage to a supply port valve electrode 141 when ink is ejected and applying voltage to a pressurizing electrode 93 with an ink supply port 79 closed. Therefore, in this case, as an opening is only the ejection port 77, pressure efficiently operates and the quantity of ejected ink becomes maximum.

In the meantime, if voltage is applied to the pressurizing electrode 93 with the ink supply port 79 completely open without applying voltage to the supply port valve electrode 141 when ink is ejected and ink is ejected from the ejection port 77, pressure is decreased and the quantity of ejected ink becomes small as shown in FIG. 31(*a*).

In the ink-jet head in the first modified example, if voltage $+V_P$ applied to the pressurizing electrode 93 is fixed and pressurized time is fixed, the numerical aperture of the ink supply port 79 is arbitrarily varied by applying suitable voltage $V_{S1}$ to the supply port valve electrode 141 and the quantity of ejected ink is controlled so that it is desired quantity.

According to a method of driving the ink-jet head in such a first modified example, the quantity of ejected ink is arbitrarily and precisely controlled by changing the numerical aperture of the ink supply port 79 and the control of gradation is enabled.

In the driving method in the first modified example, voltage and time applied to the pressurizing electrode 93 are changed, means for controlling the quantity of ink may be also combined and in this case, the more precise control of gradation is enabled.

Figure 32:
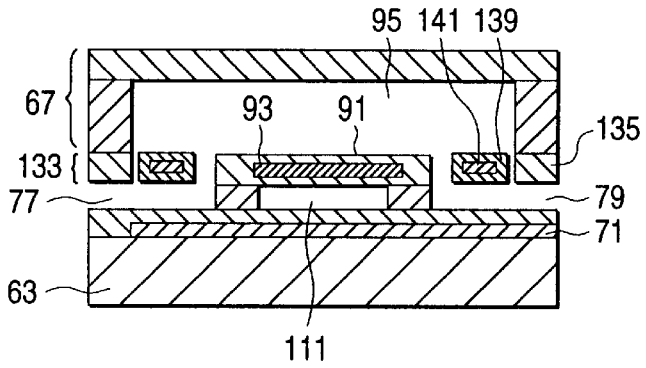
FIGS. 32(*a*) to (*e*) are sectional views for explaining the operation in a second modified example of the third embodiment.
Figure 32:
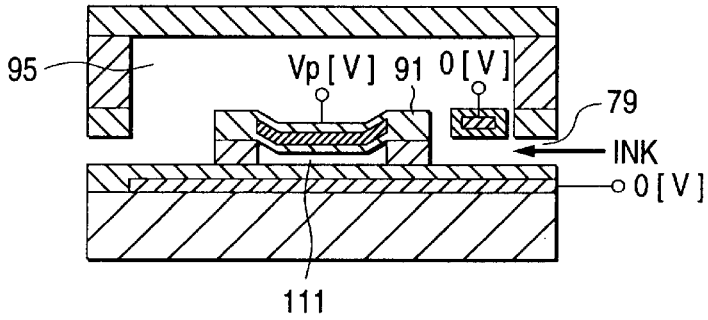
Figure 32:
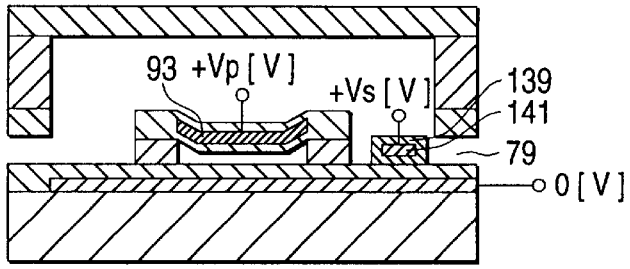
Figure 32:
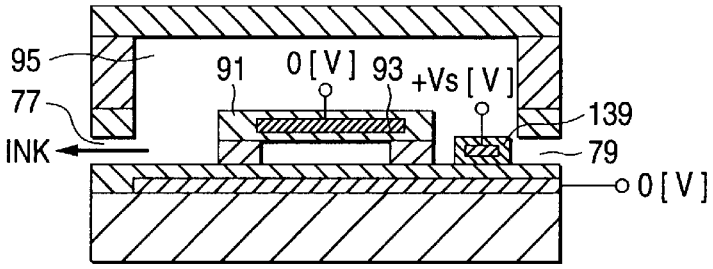
Figure 32:
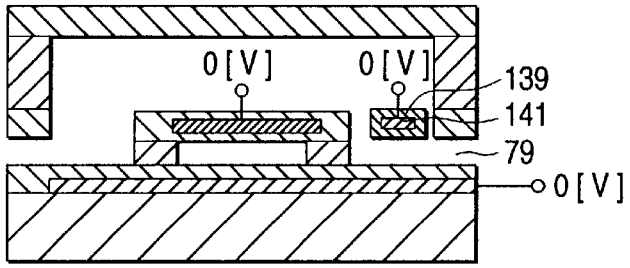
Figure 33:
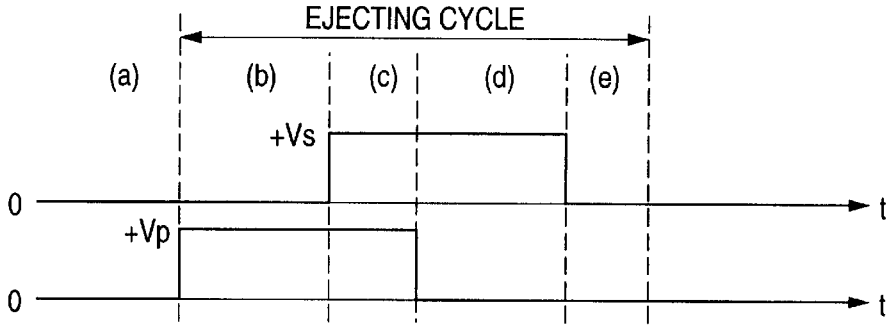
FIG. 33 is a time chart showing the driving timing in the second modified example of the third embodiment.

Next, referring to FIGS. 32(*a*) to 33, a second modified example of the third embodiment will be described. FIGS. 32(*a*) to (*e*) are sectional views for explaining the operation in the second modified example of the third embodiment and FIG. 33 is a time chart showing the driving timing in the second modified example of the third embodiment.

In the ink-jet head in the modified example, a pressurizing plate 91 is provided in an ink chamber 95 as shown in FIG. 32(*a*) and a cavity 111 which is flexible space of the pressurizing plate 91 is formed between the pressurizing plate 91 and a common electrode 71. In the modified example, the pressurizing plate 91 can be formed in the frame 135 of a valve part 133.

In the ink-jet head constituted as described above, the pressurizing plate 91 can be provided close to the common electrode 71. Therefore, the pressurizing plate 91 is not required to be provided to a cover part 67 by providing the pressurizing plate 91 in the ink chamber 95 and the cover part 67 has only to be formed only as a cover for sealing the ink chamber 95.

The operation of the ink-jet head constituted as described above will be described below.

In an unoperated state shown in FIG. 32(*a*), voltage is not applied to a supply port valve electrode 141 and a pressurizing electrode 93 as shown (a) in FIG. 33 and an ink supply port 79 becomes completely open.

In this state, voltage $+V_P$ is applied to the pressurizing electrode 93 as shown (b) in FIG. 33. Hereby, the pressurizing plate 91 is bent on the side of the cavity 111 as shown in FIG. 32(*b*) and the ink chamber 95 is decompressed. When the ink chamber 95 is decompressed, ink is supplied to the ink chamber 95 through the ink supply port 79.

Next, voltage $+V_S$ is applied to the supply port valve electrode 141 as shown (c) in FIG. 33 with voltage applied to the pressurizing electrode 93, the supply port valve plate 139 is bent as shown in FIG. 32(*c*) and closes the ink supply port 79.

Next, the pressurizing plate 91 is elastically restored in a direction in which pressure in the ink chamber 95 is increased as shown FIG. 32(*d*) by turning off the voltage of the pressurizing electrode 93 as shown (d) in FIG. 33. Hereby, ink in the ink chamber 95 is ejected from an ejection port 77 and in addition, as the ink supply port 79 is closed, the high speed, efficient and stable ejecting of ink is enabled.

Next, the supply port valve plate 139 is elastically restored as shown in FIG. 32(*e*) by turning off the voltage of the supply port valve electrode 141 as shown (e) in FIG. 33 and the ink supply port 79 is opened to get ready for the next supply of ink.

According to the ink-jet head in the second modified example, all the electrodes 71, 141 and 93 and the deforming plates can be formed over the same substrate 63. Therefore, the relative position of the movable parts can be precisely manufactured.

As an interval between the pressurizing electrode 93 and the common electrode 71 can be reduced, driving with lower voltage is enabled.

Figure 34:
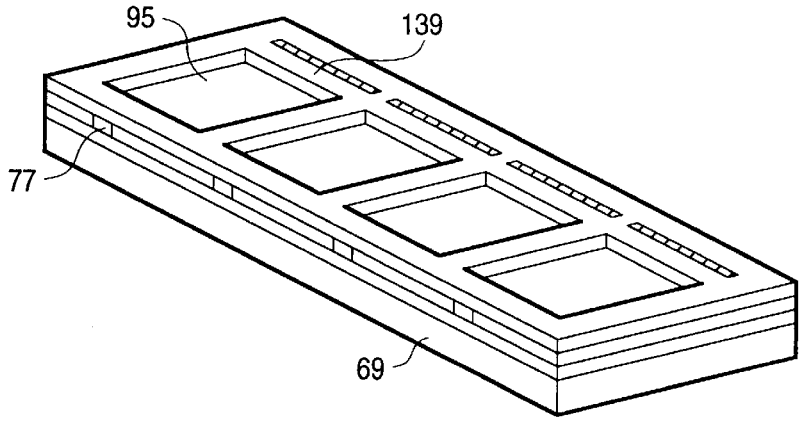
FIG. 34 is a perspective drawing showing a multi-nozzle part in a third modified example of the third embodiment.
Figure 35:
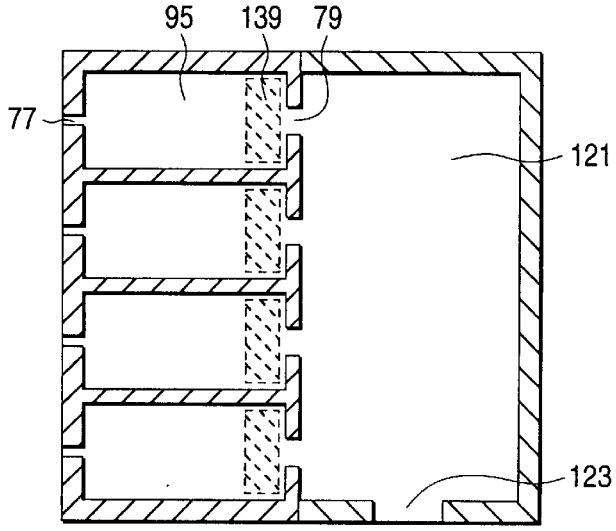
FIG. 35 is a plan view showing the inside of a multi-nozzle head in the third modified example of the third embodiment.

Next, referring to FIGS. 34 to 36(*d*), a third modified example of the third embodiment will be described. FIG. 34 is a perspective drawing of a multi-nozzle part showing the third modified example of the third embodiment, FIG. 35 is a plan view of the inside of a multi-nozzle head showing the third modified example of the third embodiment and FIGS. 36(*a*) to (*d*) are plan views showing the inside of the multi-nozzle head for explaining the operation in the third modified example of the third embodiment.

In the modified example, plural ink chambers 95 are arranged over the substrate 69, and the above supply port valve plate 139 and the above pressurizing plate 91 are provided to each ink chamber 95. A reservoir 121 communicates with the ink supply port 79 of each ink chamber 95. A port 123 connected to an ink cartridge is provided to the reservoir 121 and an ink cartridge not shown is connected to the port 123 connected to the ink cartridge.

The operation of the ink-jet head constituted as described above (the multi-nozzle ink-jet head) will be described below.

Figure 36:
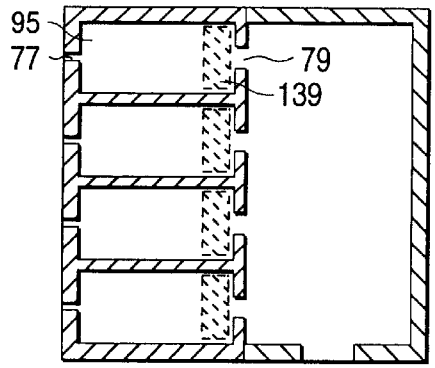
FIGS. 36(*a*) to (*d*) are plan views showing the inside of the multi-nozzle head for explaining the operation in the third modified example of the third embodiment.
Figure 36:
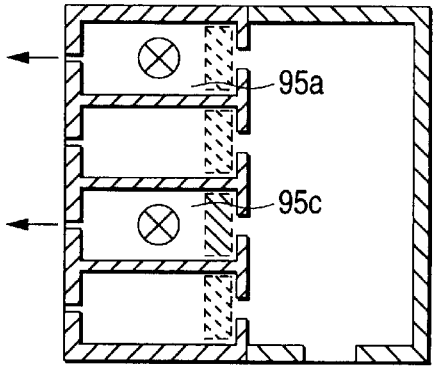
Figure 36:
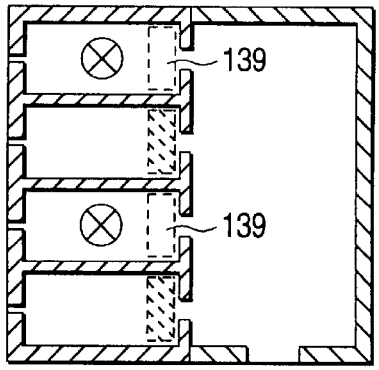
Figure 36:
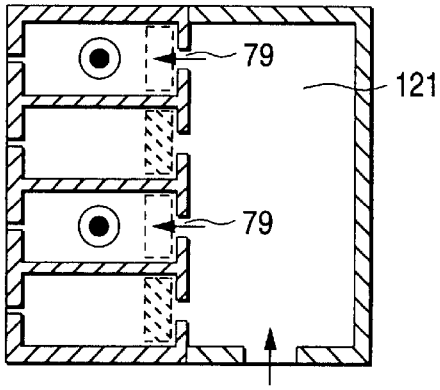

First, all the ink supply ports 79 are closed as shown in FIG. 36(*a*), in this state, arbitrary ink chambers 95*a* and 95*c* are pressurized as shown in FIG. 36(*b*) and ink is ejected.

Next, the respective supply port valve plates 139 of the pressurized ink chambers 95*a* and 95*c* are opened as shown in FIG. 36(*c*).

Next, voltage to the respective pressurizing electrodes 93 of the pressurized ink chambers 95 is turned off as shown in FIG. 36(*d*), the pressurized ink chambers 95*a* and 95*c* are decompressed by elastically restoring the respective pressurizing plates 91 and ink is supplied from the reservoir 121 via each ink supply port 79.

The multi-nozzle head portion can be integrated by photolithography, etching and others. The whole head is manufactured by bonding the reservoir 121 separately manufactured to this, however, the whole head may be also manufactured by integrating the multi-nozzle head portion and the reservoir 121.

According to the multi-nozzle ink-jet head, as all the ink supply ports 79 are closed when ink is ejected, no mutual interference of pressure is caused in adjacent ink chambers 95 and ink can be precisely ejected.

As energy and ejecting capacity required for pressurization, energy and ink supply capacity required for the supply of ink are approximately fixed independent of the number of ejection ports 77, the efficient, high speed and stable ejecting and supply of ink are enabled.

In FIGS. 36(*a*) and 36(*b*), all the ink supply ports 79 are closed, however, only the respective ink supply ports 79 of the ink chambers to jet ink 95*a* and 95*c* may be also closed.

Also, in FIGS. 36(*c*) and 36(*d*), the respective ink supply ports 79 of the pressurized ink chambers 95*a* and 95*c* are opened, however, after all the ink supply ports 79 are opened, the ink chambers 95 are decompressed and ink may be also supplied.

Next, an ink-jet head according to a fourth embodiment of the present invention will be described.

Figure 37:
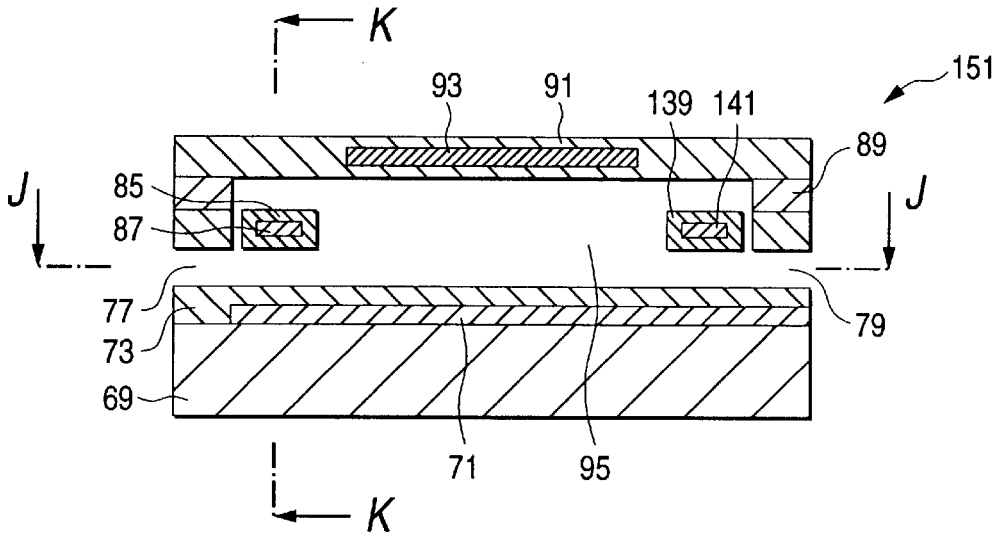
FIG. 37 is a sectional view showing an ink-jet head according to a fourth embodiment of the present invention.
Figure 38:
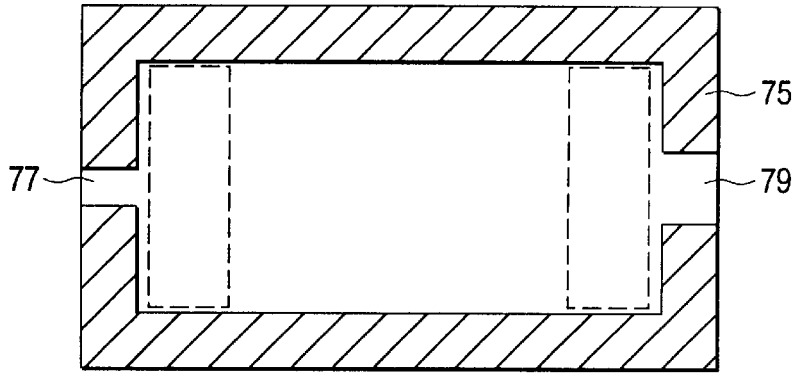
FIG. 38 is a drawing viewed along a line J—J in FIG. 37.
Figure 39:
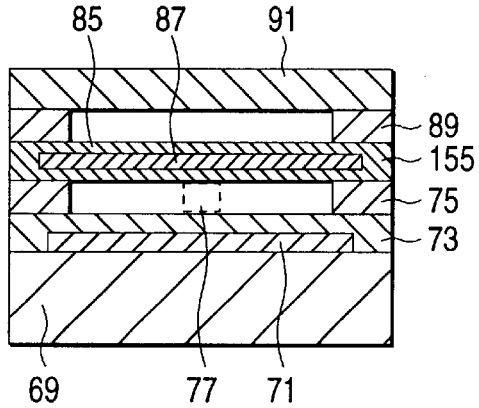
FIG. 39 is a drawing viewed along a line K—K in FIG. 37.
Figure 40:
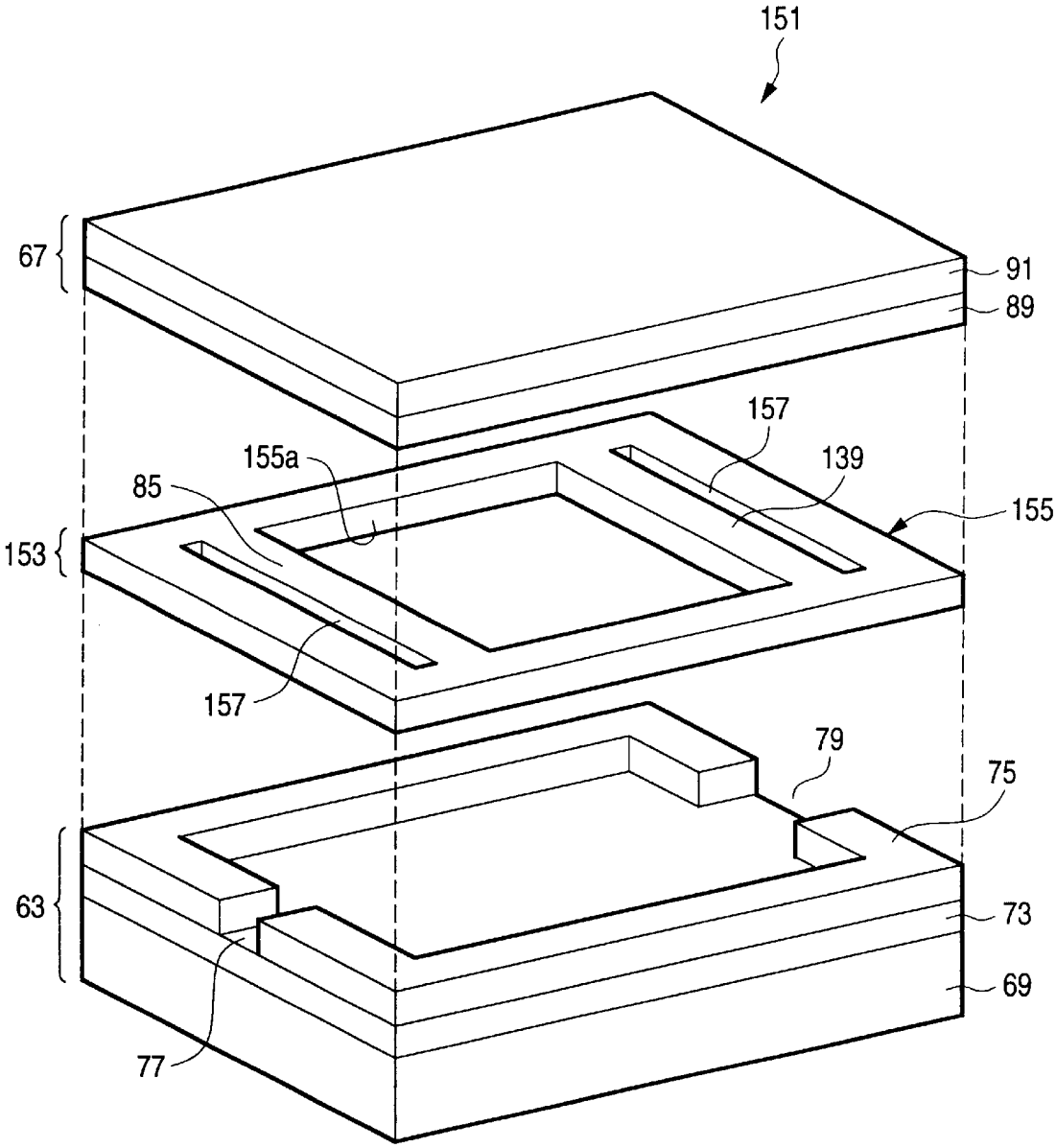
FIG. 40 is an exploded perspective drawing showing the ink-jet head in FIG. 37.

FIG. 37 is a sectional view showing the ink-jet head according to the fourth embodiment of the present invention, FIG. 38 is a drawing viewed along a line J—J in FIG. 37, FIG. 39 is a drawing viewed along a line K—K in FIG. 37 and FIG. 40 is an exploded perspective drawing showing the ink-jet head in FIG. 37.

The main part of the ink-jet head 151 according to the fourth embodiment is composed of a substrate part 63, a valve part 153 and a cover part 67. The substrate part 63 is further composed of a substrate 69, a common electrode 71, an electrode protecting layer 73 and a first peripheral wall 75. The common electrode 71 is formed on the substrate 69 and is covered with the insulating electrode protecting layer 73 formed over the substrate 69.

The first peripheral wall 75 in the shape of a rectangular frame is formed on the upper surface of the electrode protecting layer 73. A ejection port 77 is formed in one of parallel opposite walls of the first peripheral wall 75 and an ink supply port 79 is formed in the other.

The valve part 153 is made of a frame 155 in the approximate same shape as the first peripheral wall 75. The frame 155 is bonded to the upper end face of the first peripheral wall 75. Slits 157 are respectively formed in the vicinity of both ends of the frame 155 associated with the ejection port 77 and the ink supply port 79. A flexible ejection port valve plate 85 and a flexible supply port valve plate 139 respectively both ends of which are supported are formed between each slit 157 and an inner hole 155*a* by forming the slits 157 in the frame 155.

The ejection port valve plate 85 is located in the upper part of the inside opening of the ejection port 77 by laminating the frame 155 on the first peripheral wall 75. Also, the supply port valve plate 139 is located in the upper part of the inside opening of the ink supply port 79 by laminating the frame 155 on the first peripheral wall 75. A ejection port valve electrode 87 is formed inside the ejection port valve plate 85. A supply port valve electrode 141 is formed inside the supply port valve plate 139.

The cover part 67 is laminated on the upper surface of the frame 155. The cover part 67 is composed of a second peripheral wall 89 and an elastic pressurizing plate 91. The second peripheral wall 89 is a rectangular frame in the approximately same shape as the first peripheral wall 75. The pressurizing plate 91 is laminated on the upper surface of the second peripheral wall 89. A pressurizing electrode 93 is formed inside the pressurizing plate 91.

Therefore, the ink chamber 95 surrounded by the first peripheral wall 75, the frame 155 and the second peripheral wall 89 is formed between the electrode protecting layer 73 and the pressurizing plate 91. The ink chamber 95 has fluid-tight structure in a state in which only the ejection port 77 and the ink supply port 79 respectively formed in the first peripheral wall 75 are open. The ink chamber 95 is connected to a reservoir not shown via the ink supply port 79.

In an ink-jet head 151 constituted as described above, as in the first embodiment, the substrate 69 can be formed by a resin film such as polyethylene terephthalate and polycarbonate, metallic oxide, an inorganic insulator such as a ceramic or a semiconductor in addition to a transparent glass plate. The common electrode 71, the ejection port valve electrode 87, the supply port valve electrode 141 and the pressurizing electrode 93 can be formed by metal or a metallic compound having conductivity. In this case, for metal, gold, silver, palladium, zinc, aluminum and others may be used and for a metallic compound, iridium oxide, zinc oxide, aluminum oxide and others may be used.

Figure 41:
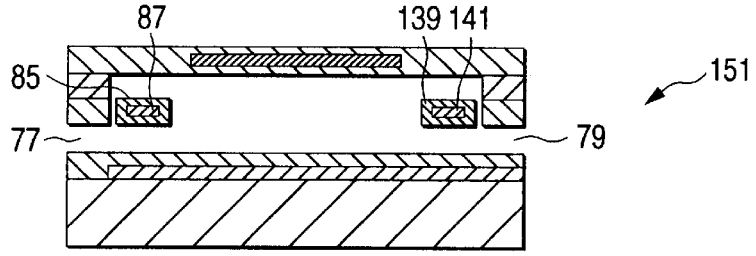
FIGS. 41(*a*) to (*f*) are sectional views for explaining the operation of the ink-jet head according to the fourth embodiment of the present invention.
Figure 41:
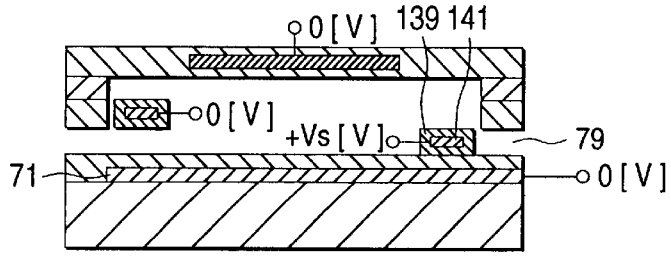
Figure 41:
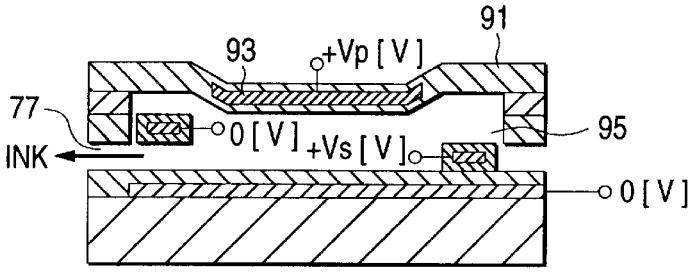
Figure 41:
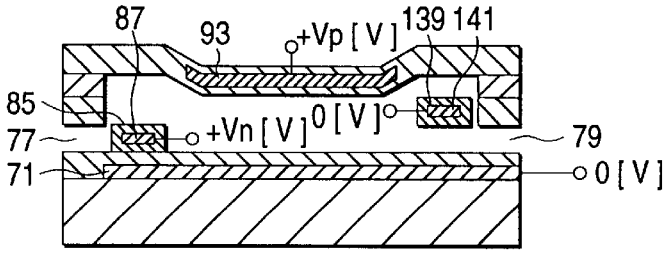
Figure 41:
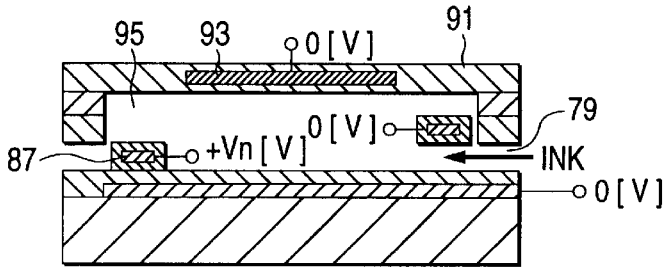
Figure 41:
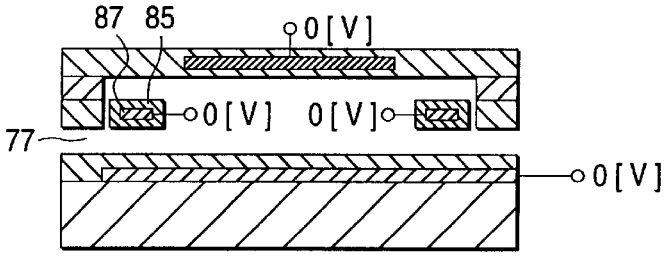

Next, the operation of the ink-jet head. 151 constituted as described above will be described. FIGS. 41(*a*) to (*f*) are sectional views for explaining the operation of the ink-jet head according to the fourth embodiment of the present invention and FIG. 42 is a time chart showing the driving timing of the ink-jet head according to the fourth embodiment of the present invention.

In the ink-jet head 151, in an unoperated state shown in FIG. 41(*a*), the ejection port valve plate 85 and the supply port valve plate 139 are respectively located in the upper part of the inside opening of the ejection port 77 and in the upper part of the inside opening of the ink supply port 79 so that the ejection port 77 and the ink supply port 79 are open.

Figure 42:
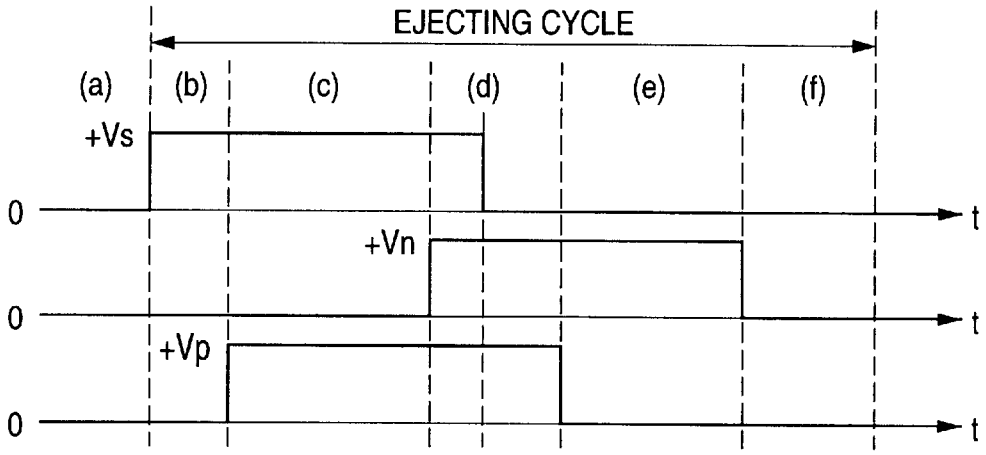
FIG. 42 is a time chart showing the driving timing of the ink-jet head according to the fourth embodiment of the present invention.

When in the unoperated state, voltage $+V_s$ is applied to the supply port valve electrode 141 as shown (b) in FIG. 42, the supply port valve plate 139 is bent on the side of the common electrode 71 with electrostatic force as shown in FIG. 41(*b*) and closes the ink supply port 79.

Next, when voltage $+V_p$ is applied to the pressurizing electrode 93 as shown (c) in FIG. 42 with voltage applied to the supply port valve electrode 141, the pressurizing plate 91 is bent on the side of the ink chamber 95 as shown in FIG. 41(*c*). Hereby, pressure in the ink chamber 95 is increased and ink in the ink chamber 95 is ejected from the ejection port 77 as an ink droplet.

Next, voltage $+V_n$ is applied to the ejection port valve electrode 87 as shown (d) in FIG. 42 with voltage applied to the pressurizing electrode 93. Hereby, the ejection port valve plate 85 is bent on the side of the common electrode 71 with electrostatic force as shown in FIG. 41(*d*) and closes the inside opening of the ejection port 77. Immediately after this, voltage $+V_s$ applied to the supply port valve electrode 141 is turned off. Hereby, the supply port valve plate 139 is elastically restored and the ink supply port 79 is opened.

When voltage to the pressurizing electrode 93 is turned off in this state as shown (e) in FIG. 42, the pressurizing plate 91 is elastically restored as shown in FIG. 41(*e*), the ink chamber 95 is decompressed and ink flows into the ink chamber 95 through the ink supply port 79.

Next, when voltage to the ejection port valve electrode 87 is turned off as shown (f) in FIG. 42, the ejection port valve plate 85 is elastically restored as shown in FIG. 41(*f*) and the ejection port 77 is opened to get ready for ejecting the next ink droplet.

As described above, according to the ink-jet head 151 according to this embodiment, as the ejection port valve plate 85 for opening or closing the ejection port 77 and the supply port valve plate 139 for opening or closing the ink supply port 79 are provided, ink can be efficiently supplied through the ink supply port by closing the ejection port 77 when ink is supplied and pressurized ink can be efficiently ejected by closing the ink supply port 79 when ink is ejected. As a result, an ejecting cycle can be remarkably reduced and high speed ejecting is enabled. Input energy can be also remarkably reduced.

Also, according to such constitution, when the ink chamber 95 is pressurized and when the ejection port valve plate 85 and the supply port valve plate 139 are closed, high speed operation by the action of electrostatic force (attractive force) is enabled. When the ink chamber 95 is decompressed and when the ejection port valve plate 85 and the supply port valve plate 139 are opened, high speed operation by the action of electrostatic force (repulsive force) and the elastic restorative force of the material is enabled. The efficient operation with low voltage of the pressurizing plate 91, the ejection port valve plate 85 and the supply port valve plate 139 is enabled by suitably designing the shape and the material of the deforming part and an interval between the electrodes dynamically and electrostatically.

Also, according to such constitution, as the ink-jet head has simple laminated structure, it can be readily manufactured. That is, after the substrate part 63, the valve part 153 and the cover part 67 respectively shown in FIG. 40 are processed by photolithography and etching, they may be also bonded, after the substrate part 63 and the valve part 153 are integrated, the cover part 67 may be also bonded to them and further, the ink-jet head can be also manufactured by integrating all. As a result, the ink-jet head can be readily manufactured and the manufacturing cost can be reduced.

It is desirable that the common electrode 71, the ejection port valve electrode 87, the supply port valve electrode 141 and the pressurizing electrode 93 are generally made of metal, however, they may be also made of a semiconductor in which high density impurities are doped. Further, it is desirable that these electrodes 71, 87, 141 and 93 are respectively covered with an insulating film 97 made of a silicon oxide film, a silicon nitride film, glass such as PSG, polyimide and others so as to protect each electrode.

A mechanical stopper not shown may be also provided to a desired position of the ink-jet head 151 to stabilize the quantity of deformation by electrostatic force and as a result, the deformed quantity of the ejection port valve plate 85, the supply port valve plate 139 and the pressurizing plate 91 is regulated so that it is fixed.

In the ink-jet head 151, as in the second embodiment, the common electrode is separated and an opposite electrode may be also independently provided to the pressurizing electrode 93, the ejection port valve electrode 87 and the supply port valve electrode 141. Hereby, electric field crosstalk between each electrode can be reduced and the ink-jet head can be more precisely operated.

In the ink-jet head 151, as in the second and third embodiments, the ejection port 77 or the ink supply port 79 may be also arranged in the cover part 67 to parallelize the operational direction of the ejection port valve plate 85 or the supply port valve plate 139 to a direction in which ink flows.

In addition, the position and the structure of the ejection port 77 or the ink supply port 79 may be also suitably determined. Further, the structure of the ejection port valve and the supply port valve has only to be structure mechanically deformed or moved by electrostatic force (attractive force or repulsive force) in addition to the above structure and for example, may be also a valve plate provided with cantilever structure, an electrostatic band-like actuator-type valve and an electrostatic rotary valve.

Next, various modified examples of the fourth embodiment will be described. These modified examples are provided with the ejection port valve plate and the supply port valve plate which are main components in the fourth embodiment in common.

Figure 43:
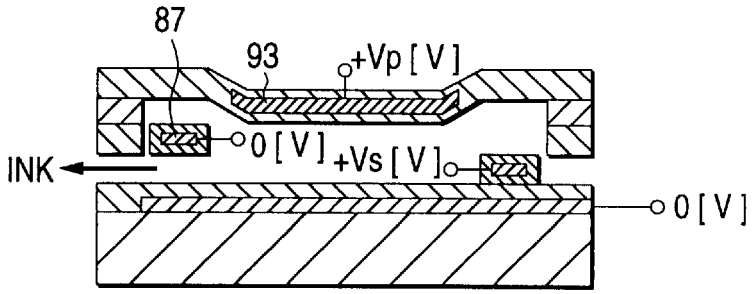
FIGS. 43(*a*) and (*b*) are sectional views for explaining the operation in a first modified example of the fourth embodiment.
Figure 43:
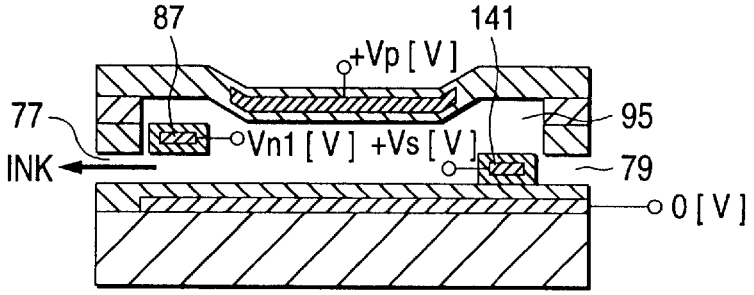

First, referring to FIGS. 43(*a*) and (*b*), a first modified example of the fourth embodiment will be described. FIGS. 43(*a*) and (*b*) are sectional views for explaining the operation in the first modified example of the fourth embodiment.

In the ink-jet head 151 described in the fourth embodiment, ink in the ink chamber 95 is ejected from the ejection port 77 with the ejection port 77 completely open by applying voltage to the pressurizing electrode 93 and the supply port valve electrode 141 without applying voltage to the ejection port valve electrode 87 when ink is ejected. Therefore, in this case, as the passage resistance of the ejection port 77 is minimum, the quantity of ejected ink becomes maximum.

In the meantime, in an ink-jet head in the first modified example, if voltage applied to a pressurizing electrode 93 is fixed and pressurized time is fixed, the numerical aperture of an ejection port 77 is arbitrarily varied by applying suitable voltage $V_{n1}$ to an ejection port valve electrode 87.

Therefore, when an ink chamber 95 is pressurized, voltage $V_s$ is applied to a supply port valve electrode 141 as shown in FIG. 43(*b*) to close an ink supply port 79 and in the meantime, the quantity of ejected ink can be controlled so that it is desired quantity by applying suitable voltage $V_{n1}$ to the ejection port valve electrode 87 and suitably controlling the numerical aperture of the ejection port 77.

According to such a method of driving the ink-jet head in the first modified example, the quantity of ejected ink can be arbitrarily and precisely controlled by changing the numerical aperture of the ejection port 77 and the control of gradation is enabled.

In the driving method in the first modified example, means for controlling the quantity of ink by changing voltage applied to the pressurizing electrode 93 and the time may be also combined and in this case, the more precise control of gradation is enabled.

Further, in the driving method in the first modified example, means for controlling pressure in the ink chamber 95 by arbitrarily changing the numerical aperture of the ink supply port 79 may be also combined to control the quantity of ink.

Figure 44:
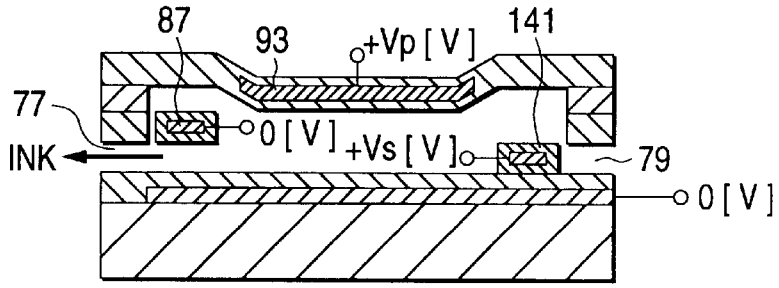
FIGS. 44(*a*) and (*b*) are sectional views for explaining the operation in a second modified example of the fourth embodiment.
Figure 44:
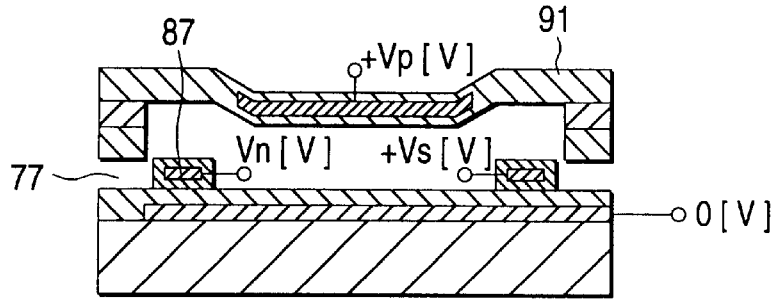

Next, referring to FIGS. 44(*a*) to 45, a second modified example of the fourth embodiment will be described. FIGS. 44(*a*) and (*b*) are sectional views for explaining the operation in the second modified example of the fourth embodiment and FIG. 45 is a time chart showing the driving timing in the second modified example of the fourth embodiment.

In the above control of gradation in the first modified example, the quantity of ejected ink is varied by changing the numerical aperture of an ejection port 77 with an ejection port valve plate 85 so as to control gradation, however, in the second modified example, the quantity of ejected ink is varied by controlling time in which the ejection port valve plate 85 is opened or closed so as to control gradation.

Figure 45:
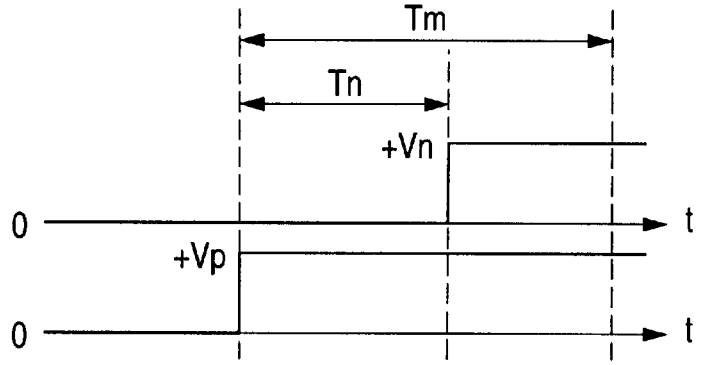
FIG. 45 is a time chart showing the driving timing in the second modified example of the fourth embodiment.

That is, when the ejecting of ink is started as shown in FIG. 45, voltage $+V_p$ is applied to a pressurizing electrode 93, voltage $+V_s$ is applied to a supply port valve electrode 141 respectively without applying voltage to an ejection port valve electrode 87 and ink is ejected from the completely open ejection port 77. At this time, the ejection port 77 is closed by applying voltage $+V_n$ to the ejection port valve electrode 87 after arbitrary time $T_n$ elapses since pressurization is started.

As shown in FIG. 45, $T_m$ denotes the longest time in which ink is ejected and $T_n$ denotes time since ink is pressurized and ejected until the ejection port 77 is closed and the ejecting of ink is stopped. Therefore, the quantity of ejected ink is precisely and arbitrarily controlled by changing $T_n$ in the range of "$0 \leqq T_n \leqq T_m m$" and the control of gradation is enabled.

In the driving method in the second modified example, means for controlling the quantity of ink by changing voltage applied to the pressurizing electrode 93 or voltage applied to the ejection port valve electrode 87 may be also combined and in this case, the more precise control of gradation is enabled.

Further, in the driving method in the second modified example, means for controlling pressure in the ink chamber 95 by arbitrarily changing the numerical aperture of the ink supply port 79 may be also combined to control the quantity of ink.

Figure 46:
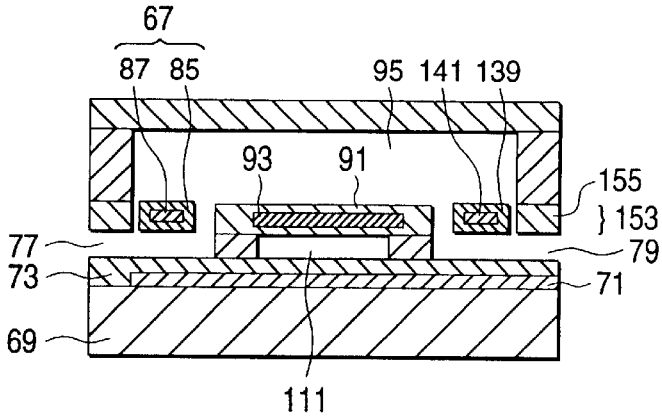
FIGS. 46(*a*) to (*e*) are sectional views for explaining the operation in a third modified example of the fourth embodiment.
Figure 46:
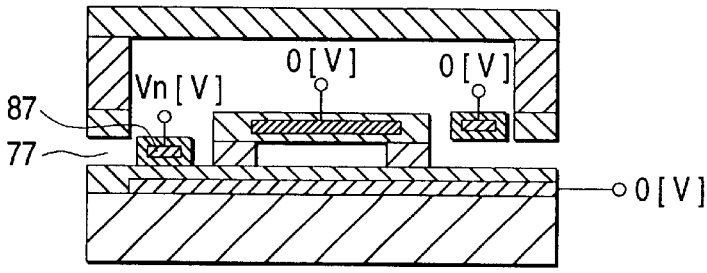
Figure 46:
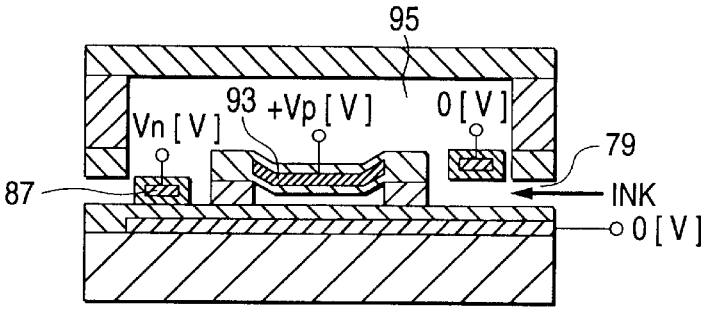
Figure 46:
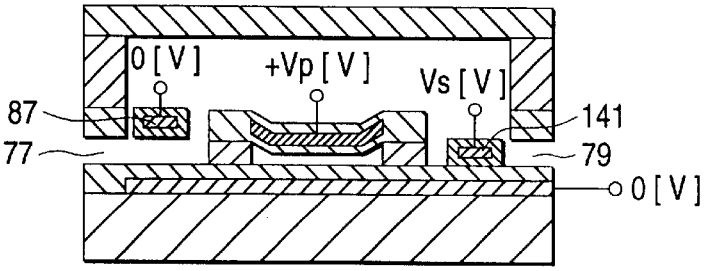
Figure 46:
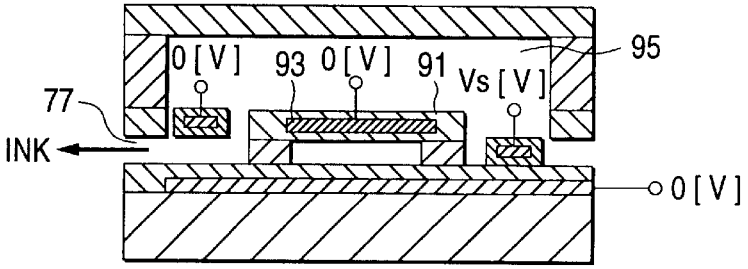
Figure 47:
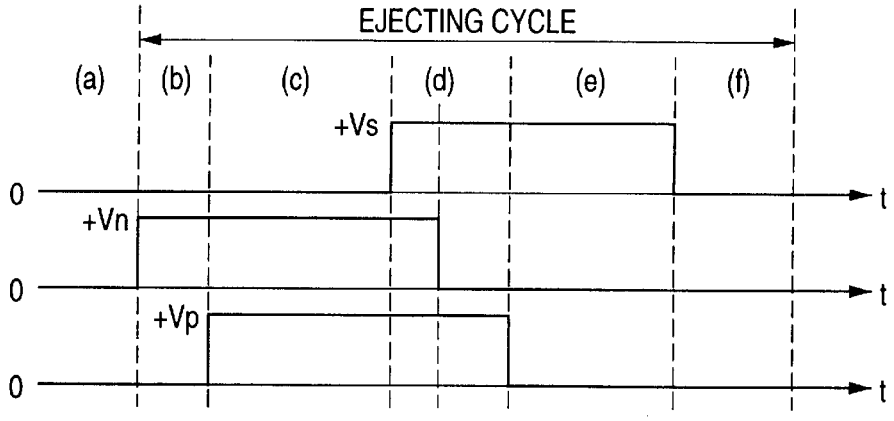
FIG. 47 is a time chart showing the driving timing in the third modified example of the fourth embodiment.

Next, referring to FIGS. 46(*a*) to 47, a third modified example of the fourth embodiment will be described. FIGS. 46(*a*) to (*e*) are sectional views for explaining the operation in the third modified example of the fourth embodiment and FIG. 47 is a time chart showing the driving timing in the third modified example of the fourth embodiment.

In an ink-jet head in the modified example, a pressurizing plate 91 is provided in an ink chamber 95 as shown in FIG. 46(*a*) and a cavity 111 which is flexible space of the pressurizing plate 91 is formed between the pressurizing plate 91 and a common electrode 71. In the modified example, the pressurizing plate 91 can be formed in the frame 155 of a valve part 153.

In the ink-jet head constituted as described above, the pressurizing plate 91 can be provided close to the common electrode 71. Therefore, the pressurizing plate 91 is not required to be provided to a cover part 67 by providing the pressurizing plate 91 in the ink chamber 95 and the cover part 67 has only to be formed as a cover for sealing the ink chamber 95.

The operation of the ink-jet head constituted as described above will be described.

In an unoperated state shown in FIG. 47(*a*), no voltage is applied to an ejection port valve electrode 87, a supply port valve electrode 141 and a pressurizing electrode 93, and an ejection port 77 and an ink supply port 79 are completely open.

In this state, voltage $+V_n$ is applied to the ejection port valve electrode 87 as shown (b) in FIG. 47, an ejection port valve plate 85 is bent as shown in FIG. 46(*b*) and the ejection port 77 is closed.

Next, voltage $+V_p$ is applied to the pressurizing electrode 93 as shown (c) in FIG. 47 with voltage applied to the ejection port valve electrode 87. Hereby, the pressurizing plate 91 is bent on the side of the cavity 111 as shown in FIG. 46(*c*) and the ink chamber 95 is decompressed. When the ink chamber 95 is decompressed, ink is supplied to the ink chamber 95 through the ink supply port 79.

Next, voltage $+V_s$ is applied to the supply port valve electrode 141 as shown (d) in FIG. 47 to close the ink supply port 79. The ejection port 77 is opened as shown in FIG. 46(*d*) by turning off voltage applied to the ejection port valve electrode 87 immediately after this.

Next, the pressurizing plate 91 is elastically restored in a direction in which pressure in the ink chamber 95 is increased as shown in FIG. 46(*e*) by turning off voltage applied to the pressurizing electrode 93 as shown (e) in FIG. 47 and hereby, ink in the ink chamber 95 is ejected from the ejection port 77.

The ink supply port 79 is opened by turning off voltage applied to the supply port valve electrode 141 as shown (i) in FIG. 47 after ink is ejected so as to get ready for the next ejecting of ink.

According to the ink-jet head in the third modified example, all the electrodes 71, 87, 141 and 93 and the deforming plates can be formed over the same substrate 69. Therefore, the relative position of the movable parts can be precisely manufactured.

As an interval between the pressurizing electrode 93 and the common electrode 71 can be reduced, driving with lower voltage is enabled.

Figure 48:
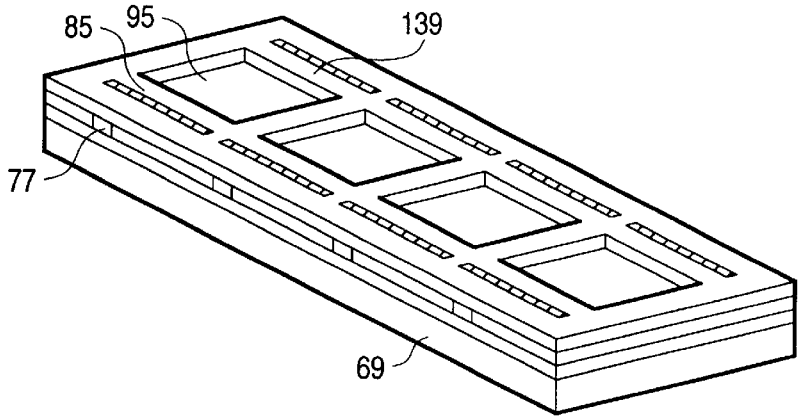
FIG. 48 is a perspective drawing showing a multi-nozzle part in a fourth modified example of the fourth embodiment.
Figure 49:
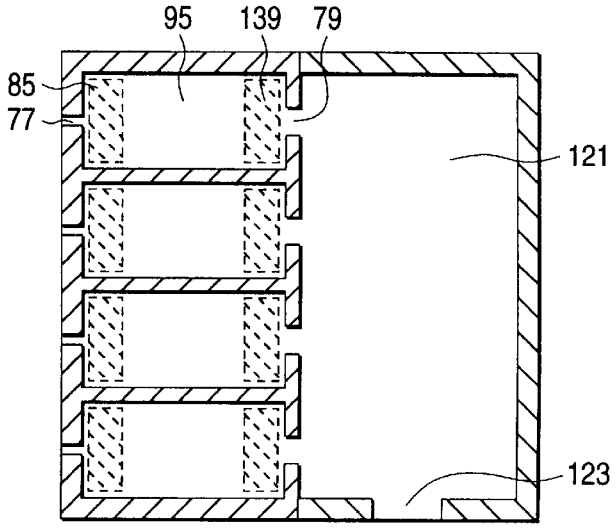
FIG. 49 is a plan view showing the inside of a multi-nozzle head in the fourth modified example of the fourth embodiment.

Next, referring to FIGS. 48 to 50(*d*), a fourth modified example of the fourth embodiment will be described. FIG. 48 is a perspective drawing showing a multi-nozzle part in the fourth modified example of the fourth embodiment, FIG. 49 is a plan view showing the inside of a multi-nozzle head in the fourth modified example of the fourth embodiment and FIGS. 50(*a*) to (*d*) are plan views showing the inside of the multi-nozzle head for explaining the operation in the fourth modified example of the fourth embodiment.

In the modified example, plural ink chambers 95 are arranged over a substrate 69, and the same ejection port valve plate 85, the same supply port valve plate 139 and the same pressurizing plate 91 as those described above are provided in each ink chamber 95. An ink supply port 79 of each ink chamber 95 communicates with a reservoir 121. A port 123 for connecting to an ink cartridge is provided to the reservoir 121 and an ink cartridge not shown is connected to the port 123 for connecting to the ink cartridge.

The operation of the ink-jet head (the multi-nozzle ink-jet head) constituted as described above will be described below.

Figure 50:
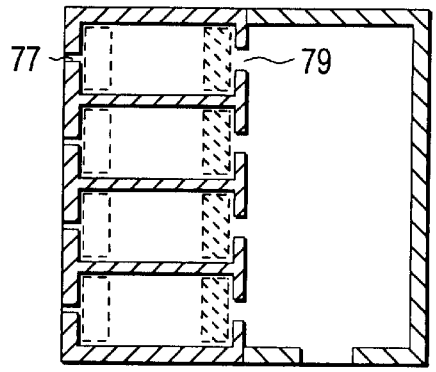
FIGS. 50(*a*) to (*d*) are plan views showing the inside of the multi-nozzle head for explaining the operation in the fourth modified example of the fourth embodiment.
Figure 50:
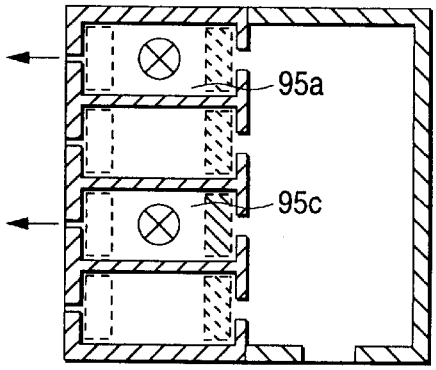
Figure 50:
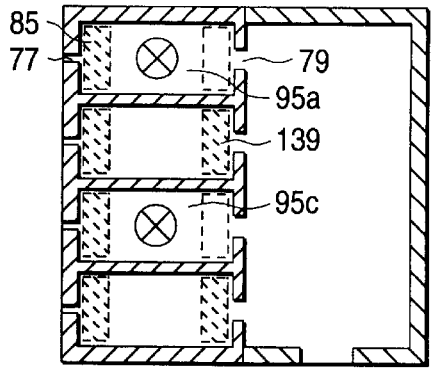
Figure 50:
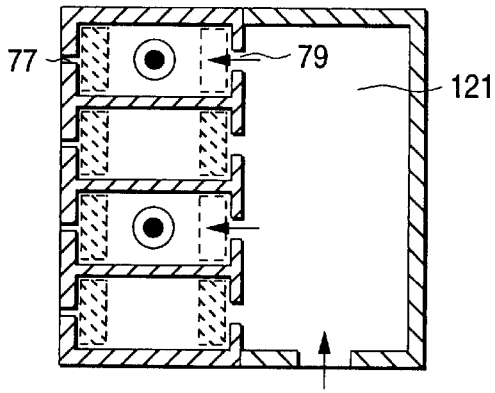
Figure 51:
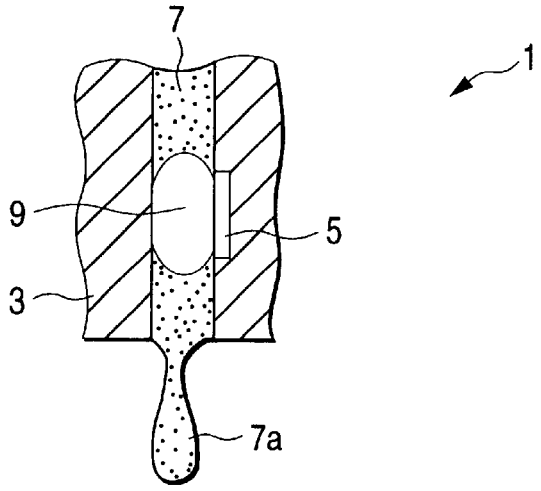
FIG. 51 is a sectional view showing a related bubble-type ink-jet head.
Figure 52:
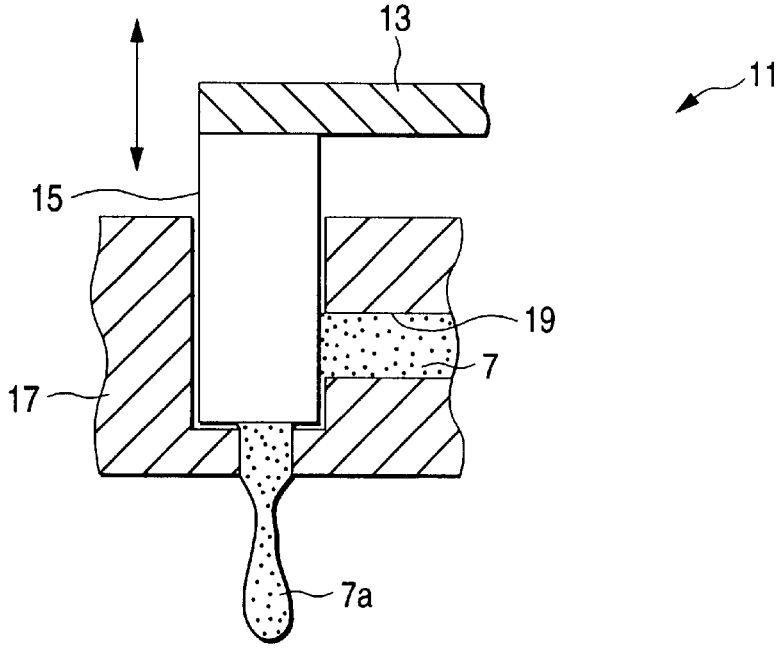
FIG. 52 is a sectional view showing a related piezoelectric element-type ink-jet head.

First, all ejection ports 77 are opened as shown in FIG. 50(*a*), all ink supply ports 79 are closed, in this state, arbitrary ink chambers 95*a* and 95*c* are pressurized as shown in FIG. 50(*b*) and ink is ejected.

Next, all the ejection ports 77 are closed by bending all ejection port valve plates 85 as shown in FIG. 50(*c*) and the respective ink supply ports 79 of the pressurized ink chambers 95*a* and 95*c* are opened by elastically restoring all supply port valve plates 139.

Next, voltage applied to the respective pressurizing electrodes 93 of the pressurized ink chambers 95*a* and 95*c* is turned off with the ejection ports 77 closed as shown in FIG. 50(*d*), the pressurized ink chambers 95*a* and 95*c* are decompressed by elastically restoring the pressurizing plates 91 and ink is supplied from the reservoir 121 via each ink supply port 79.

The multi-nozzle head portion can be integrated by photolithography, etching and others. The whole head is manufactured by bonding the reservoir 121 separately manufactured to this, however, the multi-nozzle head portion and the reservoir 121 may be also integrated.

According to the multi-nozzle ink-jet head, as all ink supply ports 79 are closed when ink is ejected, the ejecting pressure of adjacent ink chambers 95 never interfere and high quality of ink ejecting is enabled efficiently and at high speed. As all ejection ports 77 are closed when ink is supplied, no ink sucking pressure is lost when ink is supplied by reduced pressure and ink can be efficiently supplied at high speed.

As ink is sucked from the reservoir 121 by common reduced pressure, ink supply capacity can be fixed independent of the number of nozzles and stable ink supply is enabled.

Further, as energy required for pressurization and ejecting capacity or energy required for the supply of ink and ink supply capacity are approximately fixed independent of the number of ejection ports 77, the efficient, high speed and stable ejecting and supply of ink are enabled.

All the ink supply ports 79 are closed in FIGS. 50(*a*) and 50 (*b*), however, only the ink supply ports 79 of the ink chambers 95*a* and 95*c* from which ink is ejected may be also closed.

The ink supply ports 79 of the pressurized ink chambers 95*a* and 95 are opened in FIGS. 50(*c*) and 50(*d*), however, after all the ink supply ports 79 are opened, the ink chamber 95 may be also decompressed to supply ink.

As has been described heretofore, according to the present invention, as the flexible plate deforms the ink chamber by electrostatic force generated by applying voltage to the common electrode and the signal electrode and ink in the ink chamber is ejected, the ink-jet head provided with high responsibility can be obtained with low voltage, compared with cases that a heating element and a piezoelectric element are used.

According to the present invention, the ink-jet head wherein as the valve for opening or closing the ejection port or the valve for opening or closing the ink supply port is provided, ink can be efficiently supplied by closing the ejection port when ink is supplied, ink can be efficiently ejected by closing the ink supply port when ink is ejected, and high speed ejecting and efficient ejecting are enabled can be obtained.

Also, according to the present invention, the ink-jet head wherein as the quantity of ejected ink is varied by changing the numerical aperture of the ejection port or controlling time in which the ejection port is opened or closed, the high quality of control of gradation is enabled can be obtained.

Further, according to the present invention, the ink-jet head wherein as the main part such as the ink chamber can be formed in a photolithographic process, integration is enabled, the degree of the freedom of design can be enhanced, and micronization, integration and multiplicity are easy can be obtained.

What is claimed is:

1. An ink jet head comprising:

at least one ink chamber having sidewalls, an upper wall, a lower wall, an ink supply port and an ink ejection port;

a flexible member provided as the upper wall of the ink chamber;

a signal electrode provided on the flexible member;

a common electrode provided as part of the lower wall of the ink chamber that is directly opposite the upper wall, the ink chamber being disposed between the flexible member and the lower wall; and a power supply section for applying driving voltage between the signal electrode and the common electrode in accordance with print information to elastically deform the flexible member towards the common electrode by electrostatic force acting therebetween.

2. The ink-jet head as set forth in claim 1, wherein the elastic deformation of the flexible member pressurizes the ink chamber.

3. The ink-jet head as set forth in claim 2 further comprising:

a flexible valve member provided inside the ink chamber, the flexible valve member acting as a valve for at least one of the ink supply port and the ink ejection port;

a valve electrode provided on the flexible valve member;

a valve drive power supply section for applying valve driving voltage between the valve electrode and the common electrode in accordance with the print information to elastically deform the flexible valve member toward the common electrode by electrostatic force acting therebetween.

4. The ink-jet head as set forth in claim 3, wherein the common electrode is divided into a first common electrode portion opposing to the signal electrode and a second common electrode portion opposing to the valve electrode.

5. The ink-jet head as set forth in claim 3, wherein the flexible valve member is deformed in a direction which is substantially perpendicular to an ink flowing direction.

6. The ink-jet head as set forth in claim 3, wherein the flexible valve member is deformed in a direction which is substantially parallel to an ink flowing direction.

7. The ink-jet head as set forth in claim 3, wherein the valve drive power supply section applies the valve drive voltage so the flexible valve member as to deform to vary a numerical aperture of the associated port.

8. The ink-jet head as set forth in claim 3, wherein the valve drive power supply section applies the valve drive voltage so the flexible valve member as to deform to vary a reduction period of a numerical aperture of the associated port.

9. The ink-jet head as set forth in claim 3, wherein the flexible valve member acts as a valve for the ink ejection port, and wherein a numerical aperture of the ink ejection port is reduced by the valve member after the ink is ejected therefrom and then the application of the drive voltage by the power supply section is terminated.

10. The ink-jet head as set forth in claim 3, wherein the flexible valve member acts as a valve for the ink supply port, and wherein a numerical aperture of the ink supply port is reduced by the valve member after the ink is supplied therefrom and then the application of the drive voltage by the power supply section is started.

11. The ink-jet head as set forth in claim 3, wherein the flexible valve members act as valves for both the ink supply port and the ink ejection port, wherein a numerical aperture of the ink supply port is closed by the valve member after the ink is supplied therefrom and then the application of the drive voltage by the power supply section is started, and wherein a numerical aperture of the ink ejection port is closed by the valve member after the ink is ejected therefrom and then the application of the drive voltage by the power supply section is terminated.

12. The ink-jet head as set forth in claim 3 further comprising:

a common reservoir communicated with a plurality of the ink chambers arranged on one band-like common electrode in the longitudinal direction thereof, wherein the power supply section selectively applies the drive voltage to the respective signal electrode provided on each of the flexible member in accordance with the print information, and the valve drive power supply section selectively applies the valve drive voltage to the respective valve electrode provided on each of the flexible valve member in accordance with the print information.

13. The ink-jet head as set forth in claim 3, wherein at least the common electrode, the ink chamber, the flexible member and the signal electrode are formed so as to be subsequently laminated by a photolithographic process.

14. The ink-jet head as set forth in claim 3, wherein the flexible member and the flexible valve member are one of a conductor and a conductor at least a part of over which is covered with insulator.

15. The ink-jet head as set forth in claim 1, wherein the elastic deformation of the flexible member decompresses the ink chamber.

16. The ink-jet head as set forth in claim 13 further comprising:

a flexible valve member provided inside the ink chamber, the flexible valve member acting as a valve for at least one of the ink supply port and the ink ejection port;

a valve electrode provided on the flexible valve member;

a valve drive power supply section for applying valve drive voltage between the valve electrode and the common electrode in accordance with the print information to elastically deform the flexible valve member toward the common electrode by electrostatic force acting therebetween.

17. The ink-jet head as set forth in claim 16, wherein the common electrode is divided into a first common electrode portion opposing to the signal electrode and a second common electrode portion opposing to the valve electrode.

18. The ink-jet head as set forth in claim 16, wherein the flexible valve member is deformed in a direction which is substantially perpendicular to an ink flowing direction.

19. The ink-jet head as set forth in claim 16, wherein the flexible valve member is deformed in a direction which is substantially parallel to an ink flowing direction.

20. The ink-jet head as set forth in claim 16, wherein the valve drive power supply section applies the valve drive voltage so the flexible valve member as to deform to vary a numerical aperture of the associated port.

21. The ink-jet head as set forth in claim 16, wherein the valve drive power supply section applies the valve drive voltage so the flexible valve member as to deform to vary a reduction period of a numerical aperture of the associated port.

22. The ink-jet head as set forth in claim 16, wherein the flexible valve member acts as a valve for the ink ejection port, and wherein a numerical period of the ink ejection port is reduced by the valve member after the ink is ejected therefrom and then the application of the drive voltage by the power supply section is started.

23. The ink-jet head as set forth in claim 16, wherein the flexible valve member acts as a valve for the ink supply port, and wherein a numerical aperture of the ink supply port is reduced by the valve member after the ink is supplied therefrom and then the application of the drive voltage by the power supply section is terminated.

24. The ink-jet head as set forth in claim 16, wherein the flexible valve members act as valves for both the ink supply port and the ink ejection port, wherein a numerical aperture of the ink ejection port is reduced by the valve member after the ink is ejected therefrom and then the application of the drive voltage by the power supply section is started, and wherein a numerical aperture of the ink supply port is reduced by the valve member after the ink is supplied therefrom and then the application of the drive voltage by the power supply section is terminated.

25. The ink-jet head as set forth in claim 16, further comprising:

a common reservoir communicated with a plurality of the ink chambers arranged on one band-like common electrode in the longitudinal direction thereof, wherein the power supply section selectively applies the drive voltage to the respective signal electrode provided on each of the flexible member in accordance with the print information, and the valve drive power supply section selectively applies the valve drive voltage to the respective valve electrode provided on each of the flexible valve member in accordance with the print information.

26. The ink-jet head as set forth in claim 16, wherein at least the common electrode, the ink chamber, the flexible member and the signal electrode are formed so as to be subsequently laminated by a photolithographic process.

27. The ink-jet head as set forth in claim 16, wherein the flexible member and the flexible valve member are one of a conductor and a conductor at least a part of over which is covered with insulator.

28. The ink-jet head as set forth in claim 1, wherein a plurality of the ink chamber are arranged on one band-like common electrode in the longitudinal direction thereof, and the power supply section selectively applies the drive voltage to the respective signal electrode provided on each of the flexible member in accordance with the print information.

29. The ink-jet head as set forth in claim 1, wherein at least the common electrode, the ink chamber, the flexible member and the signal electrode are formed so as to be subsequently laminated by a photolithographic process.

30. The ink-jet head as set forth in claim 1, wherein the flexible member is one of a conductor and a conductor at least a part of over which is covered with insulator.

* * * * *